US005672469A

United States Patent [19]

Hioki et al.

[11] Patent Number: 5,672,469

[45] Date of Patent: *Sep. 30, 1997

[54] SILVER HALIDE PHOTOGRAHIC MATERIAL

[75] Inventors: Takanori Hioki; Mikio Ihama, both of Kanagawa, Japan

[73] Assignee: Fuji Photo Film Co., Ltd., Kanagawa, Japan

[ * ] Notice: The term of this patent shall not extend beyond the expiration date of Pat. No. 5,538,843.

[21] Appl. No.: 555,095

[22] Filed: Nov. 8, 1995

[30] Foreign Application Priority Data

Nov. 8, 1994 [JP] Japan ..... 6-298000

[51] Int. Cl.[6] ..... G03C 1/34

[52] U.S. Cl. ..... 430/614; 430/264; 430/598; 430/600; 430/603; 430/611

[58] Field of Search ..... 430/264, 598, 430/614, 600, 611, 603

[56] References Cited

U.S. PATENT DOCUMENTS

| | | | |
|---|---|---|---|
| 5,340,694 | 8/1994 | Hioki et al. | 430/264 |
| 5,340,695 | 8/1994 | Yamaguchi | 430/264 |
| 5,459,025 | 10/1995 | Hioki | 430/570 |

*Primary Examiner*—Thorl Chea

*Attorney, Agent, or Firm*—Sughrue, Mion, Zinn, Macpeak & Seas

[57] ABSTRACT

A silver halide photographic material comprising a support having thereon at least one light-sensitive layer, the photographic material comprising a reduction-sensitized silver halide emulsion containing a compound in which a group adsorptive to silver halide and a specific hydrazine structure are covalently bonded. The silver halide photographic material exhibits high sensitivity and improved fog characteristics and improved preservation stability.

6 Claims, No Drawings

SILVER HALIDE PHOTOGRAHIC MATERIAL

FIELD OF THE INVENTION

This invention relates to a silver halide photographic material containing reduction-sensitized silver halide grains.

BACKGROUND OF THE INVENTION

Attempts to increase the sensitivity of silver halide photographic materials by reduction sensitization have been made for a long time. Reduction sensitizers which have hitherto been reported to be useful include tin compounds as disclosed in U.S. Pat. No. 2,487,850, polyamine compounds as disclosed in U.S. Pat. No. 2,512,925, and thiourea dioxide compounds as disclosed in British patent 789,823. *Photographic Science and Engineering,* Vol. 23, p. 113 (1979) furnishes comparative data of the characteristics of silver nuclei prepared by various reduction sensitization techniques, in which dimethylamine borane, stannous chloride or hydrazine sensitizers are used, or so-called high pH ripening or low pAg ripening is adopted.

Techniques of reduction sensitization are also disclosed in U.S. Pat. Nos. 2,518,698, 3,201,254, 3,411,917, 3,779,777, and 3,930,867. JP-B-57-33572 and JP-B-58-1410 (the term "JP-B" as used herein means an "examined published Japanese patent application") have a mention of not only selection of reduction sensitizers but manipulations for reduction sensitization.

However, emulsions having been reduction sensitized still involve problems waiting for solution in terms of sensitivity/fog ratio and preservation stability. These problems are particularly conspicuous when reduction sensitization is combined with gold-chalcogen sensitization. When the emulsion is further subjected to spectral sensitization with sensitizing dyes, the problems become more serious, making the emulsions insufficient for practical use.

SUMMARY OF THE INVENTION

An object of the present invention is to provide a silver halide photographic material that can provide high image quality and high sensitivity and undergoes less fogging and exhibits high preservation stability.

Other objects and effects of the present invention will be apparent from the following description.

As a result of extensive investigations, the inventors have found that the above objects are accomplished by a silver halide photographic material comprising a support having thereon at least one light-sensitive llayer, the photographic material comprising a reduction-sensitized silver halide emulsion containing at least one compound represented by formula (I):

$$(\text{Het})_{k1}-(\text{Q})_{k2}-(\text{Hy})]_{k3} \qquad \text{(I)}$$

wherein Het represents a group adsorptive to silver halide grains which has any one of (1) a 5-, 6- or 7-membered heterocyclic ring having 2 or more hetero atoms, (2) a 5-, 6- or 7-membered nitrogen-containing heterocyclic ring having a quaternary nitrogen atom, which is represented by formula A:

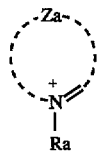

(A)

(3) a 5-, 6- or 7-membered nitrogen-containing heterocyclic ring having a thioxo group, which is represented by formula (B):

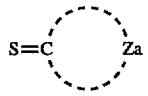

(B)

(4) a 5-, 6- or 7-membered nitrogen-containing heterocyclic ring represented by formula (C):

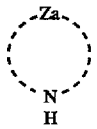

(C)

and (5) a 5-, 6- or 7-membered nitrogen-containing heterocyclic ring represented by formula (D) or (E),

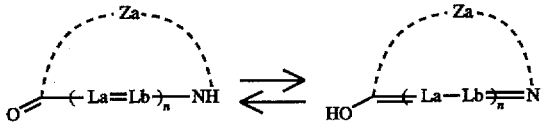

(D)

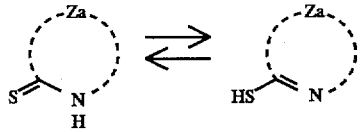

(E)

wherein Za represents an atomic group necessary to form a 5-, 6- or 7-membered nitrogen-containing heterocyclic ring; Ra represents an aliphatic group; La and Lb each represent a methine group; and n represents 0, 1 or 2, provided that Het is substituted with at least one —$(Q)_{k2}$—(Hy) moiety; Hy represents a hydrazine structure represented by formula (II):

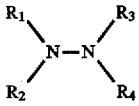

(II)

wherein $R_1$, $R_2$, $R_3$, and $R_4$ each represent an aliphatic group, an aryl group or a heterocyclic group; $R_1$ and $R_2$, $R_3$ and $R_4$, $R_1$ and $R_3$, or $R_2$ and $R_4$ may be connected to each other to form a ring, provided that at least one of $R_1$, $R_2$, $R_3$, and $R_4$ represents a divalent aliphatic, aryl or heterocyclic group to which the —$(Q)_{k2}$—$(\text{Het})_{k1}$ moiety is bonded;

Q represents a divalent linking group comprising an atom or an atomic group containing at least one of a carbon atom, a nitrogen atom, a sulfur atom, and an oxygen atom; k1 and k3 each represent 1, 2, 3 or 4; and k2 represents 0 or 1.

In an embodiment of the present invention, the above-mentioned silver halide emulsion is an emulsion which has further been sensitized by gold-chalcogen sensitization.

In another embodiment of the present invention, the above-mentioned silver halide emulsion is an emulsion which has or has not been sensitized by gold-chalcogen sensitization and has further been spectrally sensitized.

DETAILED DESCRIPTION OF THE INVENTION

A preferred embodiment of a hydrazine structure represented by formula (II) which is preferably used as Hy in formula (I) is described below in detail.

In formula (II), $R_1$, $R_2$, $R_3$, and $R_4$ each represent an aliphatic group, an aryl group or a heterocyclic group. $R_1$ and $R_2$, $R_3$ and $R_4$, $R_1$ and $R_3$, or $R_2$ and $R_4$ may be connected to each other to form a ring except an aromatic heterocyclic ring.

At least one of $R_1$, $R_2$, $R_3$, and $R_4$ should be divalent so that $—(Q)_{k2}—(Het)_{k1}$ may be bonded thereto.

The term "aliphatic group" as used herein means a straight-chain, branched or cyclic, saturated or unsaturated, and substituted or unsubstituted aliphatic hydrocarbon group and includes a substituted or unsubstituted alkyl group, a substituted or unsubstituted alkenyl group, a substituted or unsubstituted alkynyl group, a substituted or unsubstituted cycloalkyl group, and a substituted or unsubstituted cycloalkenyl group.

Examples of $R_1$, $R_2$, $R_3$, and $R_4$ include unsubstituted aliphatic groups having 1 to 18 carbon atoms, preferably 1 to 8 carbon atoms (e.g., methyl, ethyl, propyl, isopropyl, butyl, isobutyl, hexyl, octyl, dodecyl, octadecyl, cyclopentyl, cyclopropyl, and cyclohexyl) and substituted aliphatic groups having 1 to 18 carbon atoms, preferably 1 to 8 carbon atoms.

The substituents of the substituted aliphatic group, hereinafter referred to as substituent(s) V for the sake of convenience, are not particularly limited and include, for example, a carboxyl group, a sulfo group, a cyano group, a halogen atom (e.g., fluorine, chlorine, bromine, and iodine), a hydroxyl group, an alkoxycarbonyl group (e.g., methoxycarbonyl, ethoxycarbonyl, phenoxycarbonyl, and benzyloxycarbonyl), an alkoxy group (e.g., methoxy, ethoxy, benzyloxy, phenethyloxy), an aryloxy group (e.g., phenoxy, 4-methylphenoxy, and α-naphthoxy), an acyloxy group (e.g., acetyloxy and propionyloxy), an acyl group (e.g., acetyl, propionyl, benzoyl, and mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimehylsulfamoyl, morpholinosulfonyl, and piperidinosulfonyl), an aryl group (e.g., phenyl, 4-chlorophenyl, 4-methylphenyl, and α-naphthyl), a heterocyclic group (e.g., 2-pyridyl, tetrahydrofurfuryl, morpholino, and 2-thienyl), an amino group (e.g., amino, dimethylamino, anilino, and diphenylamino), an alkylthio group (e.g., methylthio and ethylthio), an alkylsulfonyl group (e.g., methylsulfonyl and propylsulfonyl), an alkylsulfinyl group (e.g., methylsulfinyl), a nitro group, a phospho group, an acylamino group (e.g., acetylamino), an ammonium group (e.g., trimethylammonium and tributylammonium), a mercapto group, a hydrazino group (e.g., trimethylhydrazino), a ureido group (e.g., ureido and N,N-dimethylureido), an imido group, an unsaturated hydrocarbon group (e.g., vinyl, ethenyl, 1-cyclohexenyl, benzylidyne, and benzylidene), an aryl group (e.g., phenyl and naphthyl), and a heterocyclic group (e.g., pyridyl). Substituent V preferably contains 1 to 18 carbon atoms, still preferably 1 to 8 carbon atoms. These groups as substitutent V may further be substituted with other substituents V.

Specific examples of preferred groups as $R_1$, $R_2$, $R_3$, and $R_4$ include aliphatic groups, such as carboxymethyl, 2-carboxyethyl, 3-carboxypropyl, 4-carboxybutyl, 2-sulfoethyl, 3-sulfopropyl, 4-sulfobutyl, 3-sulfobutyl, 2-hydroxy-3-sulfopropyl, 2-cyanoethyl, 2-chloroethyl, 2-bromoethyl, 2-hydroxyethyl, 3-hydroxypropyl, hydroxymethyl, 2-hydroxyethyl, 2-methoxyethyl, 2-ethoxyethyl, 2-ethoxycarbonylethyl, methoxycarbonylmethyl, 2-methoxyethyl, 2-ethoxyethyl, 2-phenoxyethyl, 2-acetyloxyethyl, 2-propionyloxyethyl, 2-acetylethyl, 3-benzoylpropyl, 2-carbamoylethyl, 2-morpholinocarbonylethyl, sulfamoylmethyl, 2-(N,N-dimethylsulfamoyl)ethyl, benzyl, 2-naphthylethyl, 2-(2-pyridyl)ethyl, allyl, 3-aminopropyl, 3-dimethylaminopropyl, methylthiomethyl, 2-methylsulfonylethyl, methylsulfinylmethyl, 2-acetylaminoethyl, 3-trimethylammoniumethyl, 2-mercaptoethyl, 2-trimethylhydrazinoethyl, methylsulfonylcarbamoylmethyl, and (2-methoxy) ethoxymethyl; aryl groups having 6 to 18 carbon atoms, preferably 6 to 12 carbon atoms, such as phenyl, α-naphthyl, β-naphthyl, and phenyl or naphthyl substituted by substituent V or an aliphatic group; and heterocyclic groups having 4 to 18 carbon atoms, still preferably 4 to 12 carbon atoms, such as 2-pyridyl and 2-pyridyl substituted with substituent V or an aliphatic group.

$R_1$ and $R_2$, $R_3$ and $R_4$, $R_1$ and $R_3$, or $R_2$ and $R_4$ may be connected to each other to form a ring except an aromatic heterocyclic ring. The ring formed may be substituted with substituent V.

It is preferable that $R_1$, $R_2$, $R_3$, and $R_4$ each represent an substituted or unsubstituted aliphatic group, or $R_1$ and $R_2$, $R_3$ and $R_4$, $R_1$ and $R_3$, or $R_2$ and $R_4$ are connected to each other to form an alkylene group containing no hetero atom (e.g., oxygen, sulfur or nitrogen) (the alkylene group may be substituted with, e.g., substituent V) to thereby form a ring.

It is still preferable that $R_1$, $R_2$, $R_3$, and $R_4$ each represent a group in which the carbon atom directly bonded to the nitrogen atom of the hydrazine structure is an unsubstituted methylene group. Particularly preferably, $R_1$, $R_2$, $R_3$, and $R_4$ each represent an unsubstituted alkyl group having 1 to 6 carbon atoms (e.g., methyl, ethyl, propyl or butyl), a substituted alkyl group having 1 to 8 carbon atoms, such as a sulfoalkyl group (e.g., 2-sulfoethyl, 3-sulfopropyl, 4-sulfobutyl or 3-sulfobutyl), a carboxyalkyl group (e.g., carboxymethyl or 2-carboxyethyl), or a hydroxylakyl group (e.g., 2-hydroxyethyl), or $R_1$ and $R_2$, $R_3$ and $R_4$, $R_1$ and $R_3$, or $R_2$ and $R_4$ are connected to each other to form an alkylene group to thereby form a 5-, 6- or 7-membered ring.

The hydrazine structure represented by formula (II) is substituted with at least one $—(Q)_{k2}—(Het)_{k1}$ moiety at any position of $R_1$, $R_2$, $R_3$ and $R_4$.

The hydrazine compound of formula (II) may be isolated in the form of a salt if advantageous for synthesis and/or preservation. Compounds forming a salt with the hydrazine compound of formula (II) are not limited. Examples of suitable hydrazine salts are arylsulfonates (e.g., p-toluenesulfonate and p-chlorobenzenesulfonate), aryldisulfonates (e.g., 1,3-benzenedisulfonate, 1,5-naphthalenedisulfonate, and 2,6-naphthalenedisulfonate), a thiocyanate, a picrate, carboxylates (e.g., oxalate, acetate, benzoate, and hydrogenoxalate), hydrohalogenates (e.g., hydrochloride, hydrofluoride, hydrobromide, and hydroiodide), a sulfate, a perchlorate, a tetrafluoroborate, a sulfite, a nitrate, a phosphate, a carbonate, and a hydrogencarbonate, with a hydrogenoxalate, an oxalate, and a hydrochloride being preferred.

The compound of formula (II) is preferably selected from the compounds represented by formulae (III) to (V):

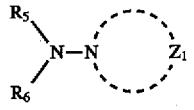

(III)

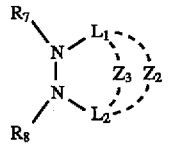

(IV)

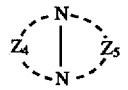

(V)

wherein $R^5$, $R^6$, $R^7$, and $R^8$ each represent an aliphatic group, an aryl group or a heterocyclic group; or $R_5$ and $R_6$, or $R_7$ and $R_8$ may be connected to each other to form a ring; $Z_1$ represents an alkylene group having 4 to 6 carbon atoms; $Z_2$ represents an alkylene group having 2 carbon atoms; $Z_3$ represents an alkylene group having 1 or 2 carbon atoms; $Z_4$ and $Z_5$ each represent an alkylene group having 3 carbon atoms; and $L_1$ and $L_2$ each represent a methine group.

The compounds of formulae (III) to (V) are substituted with at least one $—(Q)_{k2}—(Het)_{k1}$ moiety.

Of the compounds of formulae (III) to (V), the compounds of formula (III) and the compounds of formula (IV) are preferred, with the compounds of formula (III) being still preferred.

In formula (III), $R_5$ and $R_6$ have the same meaning as $R_1$, $R_2$, $R_3$, and $R_4$. The preferred ranges of $R_1$, $R_2$, $R_3$, and $R_4$ also apply to $R_5$ and $R_6$. It is particularly preferable that $R_5$ and $R_6$ both represent an alkyl group or they are taken together to form an unsubstituted tetramethylene or pentamethylene group.

$Z_1$ represents a substituted or unsubstituted alkylene group having 4 to 6 carbon atoms, preferably 4 or 5 carbon atoms, provided that the carbon atom directly bonded to the nitrogen atom of the hydrazine structure is not substituted with an oxo group.

The substituent of substituted alkylene group $Z_1$ includes substituents V. The carbon atom directly bonded to the nitrogen atom of the hydrazine structure is preferably that of an unsubstituted methylene group.

$Z_1$ is preferably an unsubstituted tetramethylene group or an unsubstituted pentamethylene group.

The hydrazine structure represented by formula (III) is substituted with at least one $—(Q)_{k2}—(Het)_{k1}$ moiety at any of the positions of $R_5$, $R_6$, and $Z_1$, preferably at $R_5$ and/or $R_6$.

In formula (IV), $R_7$ and $R_8$ have the same meaning as $R_1$, $R_2$, $R_3$, and $R_4$. The preferred ranges of $R_1$, $R_2$, $R_3$, and $R_4$ also apply to $R_7$ and $R_8$. It is particularly preferable that $R_7$ and $R_8$ both represent an alkyl group or they are taken together to form a trimethylene group.

$Z_2$ represents a substituted or unsubstituted alkylene group having 2 carbon atoms, and $Z_3$ represents a substituted or unsubstituted alkylene group having 1 or 2 carbon atoms.

The substituent of the substituted alkylene group $Z_2$ or $Z_3$ includes substituents V.

$Z_2$ is preferably an unsubstituted ethylene group, and $Z_3$ is preferably an unsubstituted ethylene or ethylene group.

$L_1$ and $L_2$ each represent a substituted or unsubstituted methine group. The substituent of the substituted methine group $L_1$ or $L_2$ includes substituents V and preferably an unsubstituted alkyl group (e.g., methyl or t-butyl). $L_1$ and $L_2$ each preferably represent an unsubstituted methine group.

The hydrazine structure represented by formula (IV) is substituted with at least one $—(Q)_{k2}—(Het)_{k1}$ moiety at any of the positions of $R_7$, $R_8$, $Z_2$, $Z_3$, $L_1$, and $L_2$, preferably at $R_7$ and/or $R_8$.

In formula (V), $Z_4$ and $Z_5$ each represent a substituted or unsubstituted alkylene group having 3 carbon atoms, provided that the carbon atom directly bonded to the nitrogen atom of the hydrazine structure is not substituted with an oxo group.

The substituent of the substituted alkylene group $Z_4$ or $Z_5$ includes substituents V. The carbon atom directly bonded to the nitrogen atom of the hydrazine is preferably that of an unsubstituted methylene group.

$Z_4$ and $Z_5$ are each preferably an unsubstituted trimethylene group or a trimethylene group substituted with an unsubstituted alkyl group (e.g., 2,2-dimethyltrimethylene).

The hydrazine structure represented by formula (V) is substituted with at least one $—(Q)_{k2}—(Het)_{k1}$ moiety at $Z_4$ and/or $Z_5$.

As previously mentioned as to the compounds of formula (II), the compounds of formulae (III) to (V) may be isolated in the form of a salt. The salts include those enumerated for the compounds of formula (II), preferably a hydrogenoxalate, an oxalate, and a hydrochloride.

The group as represented by Met in formula (I) has any one of the above-described structures (A) to (E).

The aliphatic group as represented by Ra preferably includes those described for $R_1$, $R_2$ and $R_3$.

The nitrogen-containing heterocyclic ring formed by Za is a 5-, 6- or 7-membered ring containing at least one nitrogen atom, which may further contain other hereto atoms, e.g., oxygen, sulfur, selenium or tellurium. Preferred heterocyclic rings include azole rings (e.g., imidazole, triazole, tetrazole, oxazole, selenazole, benzimidazole, benzotriazole, benzoxazole, benzothiazole, thiadiazole, oxadiazole, benzoselenazole, pyrazole, naphthothiazole, naphthoimidazole, naphthoxazole, azabenzimidazole, and purine), a pyrimidine ring, a triazine ring, and azaindene rings (e.g., triazaindene, teraazaindene, and pentaazaindene).

The group Het is substituted with at least one $—(Q)_{k2}—(Het)_{k1}$ moiety.

Het preferably includes structures represented by formulae (VI) to (X):

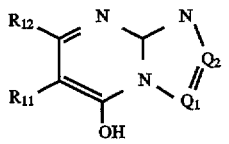

(VI)

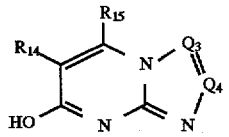

(VII)

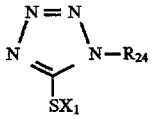

(VIII)

-continued

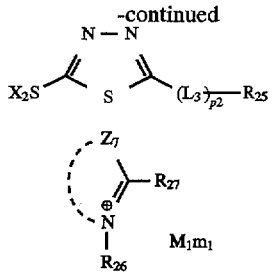

wherein one of $Q_1$ and $Q_2$ represents a nitrogen atom, and the other represents C—$R_{13}$; one of $Q_3$ and $Q_4$ represents a nitrogen atom, and the other represents C—$R_{16}$; $R_{11}$, $R_{12}$, $R_{13}$, $R_{14}$, $R_{15}$, and $R_{16}$ each represent a hydrogen atom or a monovalent substituent; $R_{24}$ represents an aliphatic group, an aryl group or a heterocyclic group; $X_1$ represents a hydrogen atom, an alkali metal atom, an ammonium group or a precursor thereof; $Y_1$ represents an oxygen atom, a sulfur atom, =NH, =N—$(L_4)_{p3}$—$R_{28}$; $L_3$ and $L_4$ each represent a divalent linking group; $R_{25}$ and $R_{28}$ each represent a hydrogen atom, an aliphatic group, an aryl group or a heterocyclic group; $X_2$ has the same meaning as $X_1$; p2 and p3 each represent an integer of 0 to 3; $Z_7$ represents an atomic group necessary to form a 5- or 6-membered nitrogen-containing heterocyclic ring; $R_{26}$ represents an aliphatic group; and $R_{27}$ represents a hydrogen atom or an aliphatic group; provided that the structure represented by formula (VI) to (X) is substituted with at least one —$(Q)_{k2}$—(Hy) moiety at any position except $X_1$ in formula (VIII) and $X_2$ in formula (IX).

Of the structures of formulae (VI) to (X) those of formula (VI), (VIII), and (IX) are preferred, and those of formula (VIII) are still preferred.

In formulae (VI) to (X), $R_{11}$, $R_{12}$, $R_{13}$, $R_{14}$, $R_{15}$, and $R_{16}$ each represent a hydrogen atom or a monovalent substituent. The monovalent substituent includes those mentioned above as preferred examples of $R_1$, $R_2$, $R_3$, $R_4$, and substituents V, preferably a lower alkyl group (still preferably a substituted or unsubstituted alkyl group having 1 to 4 carbon atoms, e.g., methyl, ethyl, n-propyl, isopropyl, n-butyl, t-butyl, methoxyethyl, hydroxyethyl, hydroxymethyl, vinyl or allyl), a carboxyl group, an alkoxy group (still preferably a substituted or unsubstituted alkoxy group having 1 to 5 carbon atoms, e.g., methoxy, ethoxy, methoxyethoxy or hydroxyethoxy), an aralkyl group (still preferably a substituted or unsubstituted aralkyl group having 7 to 12 carbon atoms, e.g., benzyl, phenethyl or phenylpropyl), an aryl group (still preferably a substituted or unsubstituted aryl group having 6 to 12 carbon atoms, e.g., phenyl, 4-methylphenyl or 4-methoxyphenyl), a heterocyclic group (e.g., 2-pyridyl), an alkylthio group (still preferably a substituted or unsubstituted alkylthio group having 1 to 10 carbon atoms, e.g., methylthio or ethylthio), an arylthio group (still preferably a substituted or unsubstituted arylthio group having 6 to 12 carbon atoms, e.g., phenylthio), an aryloxy group (still preferably a substituted or unsubstituted aryloxy group having 6 to 12 carbon atoms, e.g., phenoxy), an alkylamino group having 3 or more carbon atoms (e.g., propylamino or butylamino), an arylamino group (e.g., anilino), a halogen atom (e.g., chlorine, bromine or fluorine), and the following groups:

(IX)

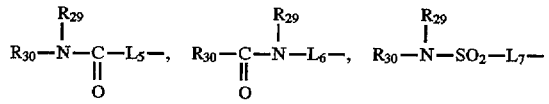

(X)

wherein $L_5$, $L_6$, and $L_7$ each represent an alkylene group (still preferably an alkylene group having 1 to 5 carbon atoms, e.g., methylene, propylene or 2-hydroxypropylene); $R_{29}$ and $R_{30}$, which may be the same or different, each represent a hydrogen atom, an aliphatic group (still preferably a substituted or unsubstituted aliphatic group having 1 to 10 carbon atoms, e.g., methyl, ethyl, n-propyl, isopropyl, n-butyl, t-butyl, n-octyl, methoxyethyl, hydroxyethyl, allyl or propargyl), an aralkyl group (still preferably a substituted or unsubstituted aralkyl group having 7 to 12 carbon atoms, e.g., benzyl, phenethyl or vinylbenzyl), an aryl group (still preferably a substituted or unsubstituted aryl group having 6 to 12 carbon atoms, e.g., phenyl or 4-methylphenyl) or a heterocyclic group (e.g., 2-pyridyl).

The aliphatic group, aryl group or heterocyclic group as $R_{24}$ may be substituted or unsubstituted. The substituent of the substituted aliphatic, aryl or heterocyclic group $R_{24}$ preferably includes those mentioned above as examples of $R_1$, $R_2$, $R_3$, $R_4$, and substituents V, still preferably a halogen atom (e.g., chlorine, bromine or fluorine), a nitro group, a cyano group, a hydroxyl group, an alkoxy group (e.g., methoxy), an aryl group (e.g., phenyl), an acylamino group (e.g., propionylamino), an alkoxycarbonylamino group (e.g., methoxycarbonylamino), a ureido group, an amino group, a heterocyclic group (e.g., 2-pyridyl), an acyl group (e.g., acetyl), a sulfamoyl group, a sulfonamido group, a thioureido group, a carbamoyl group, an alkylthio group (e.g., methylthio), an arylthio group (e.g., phenylthio), a heterocyclic thio group (e.g., 2-benzothiazolylthio), a carboxyl group, a sulfo group, or a salt thereof. Of these groups, the ureido group, thioureido group, sulfamoyl group, carbamoyl group, and amino groups each may be unsubstituted or substituted with an alkyl group or an aryl group at the nitrogen atom thereof.

The aryl group as $R_{24}$ includes a phenyl group and a substituted phenyl group, in which the substituent includes those mentioned above as preferred examples of $R_1$, $R_2$, $R_3$, $R_4$, and substituents V.

The alkali metal atom as represented by $X_1$ or $X_2$ includes a sodium atom and a potassium atom, and the ammonium group as $X_1$ or $X_2$ includes tetramethylammonium and trimethylbenzylammonium. The term "precursor" as used for $X_1$ or $X_2$ denotes a group capable of becoming a hydrogen atom, an alkali metal or an ammonium group under an alkaline condition, such as an acetyl group, a cyanoethyl group, or a methanesulfonylethyl group.

Examples of the divalent linking group as represented by $L_3$ or $L_4$ include the following linking groups and combinations thereof.

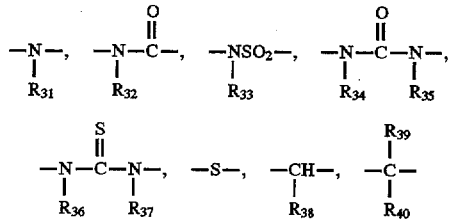

wherein $R_{31}$, $R_{32}$, $R_{33}$, $R_{34}$, $R_{35}$, $R_{36}$, $R_{37}$, $R_{38}$, $R_{39}$, and $R_{40}$ each represent a hydrogen atom, an aliphatic group (preferably a substituted or unsubstituted aliphatic group having 1 to 4 carbon atoms, e.g., methyl, ethyl, n-butyl, methoxyethyl, hydroxyethyl or allyl) or an aralkyl group (preferably a substituted or unsubstituted aralkyl group having 7 to 12 carbon atoms, e.g., benzyl, phenethyl or phenylpropyl).

$R_{25}$ and $R_{26}$ preferably include the groups mentioned above as preferred examples of $R_{24}$.

$Z_7$ preferably represents thiazoliums (e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, and naphtho[2,1-d]thiazolium), oxazoliums (e.g., oxazolium, 4-methyloxazolium, benzoxazolium, 5-chlorobenzoxazolium, 5-phenylbenzoxazolium, 5-methylbenzoxazolium, and naphtho[1,2-d]oxazolium), imidazoliums (e.g., 1-methylbenzimidazolium, 1-propyl-5-chlorobenzimidazolium, 1-ethyl-5,6-dichlorobenzimidazolium, and 1-allyl-5-trifluoromethyl-6-chloro-benzimidazolium) or selenazoliums (e.g., benzoselenazolium, 5-chlorobenzoselenazolium, 5-methylbenzoselenazolium, 5-methoixybenzoselenazolium, and naphtho[1,2-d] selenazolium). Thiazoliums, e.g., benzothiazolium, 5-chlorobenzothiazolium, 5-methoxybenzothiazolium, and naphtho[1,2-d]thiazolium, are still preferred.

$R_{26}$ and $R_{27}$ each preferably represent a hydrogen atom or an alkyl group having 1 to 18 carbon atoms (e.g., methyl, ethyl, propyl, butyl, pentyl, octyl, decyl, dodecyl or octadecyl) which may be substituted with, e.g., a vinyl group, a carboxyl group, a sulfo group, a cyano group, a halogen atom (e.g., fluorine, chlorine or bromine), a hydroxyl group, an alkoxycarbonyl group having 1 to 8 carbon atoms (e.g., methoxycarbonyl, ethoxycarbonyl, phenoxycarbonyl or benzyloxycarbonyl), an alkoxy group having 1 to 8 carbon atoms (e.g., methoxy, ethoxy, benzyloxy or phenethyloxy), a monocyclic aryloxy group having 6 to 10 carbon atoms (e.g., phenoxy or p-tolyloxy), an acyloxy group having 1 to 3 carbon atoms (e.g., acetyloxy or propionyloxy), an acyl group having 1 to 8 carbon atoms (e.g., acetyl, propionyl, benzoyl or mesyl), a carbamoyl group (e.g., carbamoyl, N,N-dimethylcarbamoyl, morpholinocarbonyl or piperidinocarbonyl), a sulfamoyl group (e.g., sulfamoyl, N,N-dimethylsulfamoyl, morpholinosulfonyl or piperidinosulfonyl) or an aryl group having 6 to 10 carbon atoms (e.g., phenyl, 4-chlorophenyl, 4-methylphenyl or α-naphthyl), with the proviso that $R_{26}$ does not represent a hydrogen atom.

$R_{26}$ still preferably represents an unsubstituted alkyl group (e.g., methyl or ethyl) or an alkenyl group (e.g., allyl), and $R_{27}$ still preferably represents a hydrogen atom or an unsubstituted lower alkyl group (e.g., methyl or ethyl).

In formula (X), $M_1$ and $m_1$ indicate presence or absence of a cation or an anion which may be necessary for neutralizing the ionic charge of the compound of formula (X). Whether a dye is a cation or an anion or whether or not it has a net ionic charge depends on the auxochrome and substituents of the dye. Typical cations are organic or inorganic ammonium ion and an alkali metal ion. Anions, which may be organic or inorganic, include halide ions (e.g., fluoride ion, chloride ion, bromide ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion, and 2,6-naphthalenedisulfonate ion), alkylsulfate ions (e.g., methylsulfonate ion), a sulfate ion, a thiocyanate ion, a perchlorate ion, a tetrafluoroborate ion, a picrate ion, an acetate ion, and a trifluoromethanesulfonate ion. An ammonium ion, an iodide ion, a bromide ion and p-toluenesulfonate ion are preferred.

Each of the nitrogen-containing heterocyclic rings represented by formulae (VI) to (X) is substituted with at least one $-(Q)_{k2}-(Hy)$ moiety at $R_{11}$, $R_{12}$, $R_{13}$, $R_{14}$, $R_{15}$, $R_{16}$, $R_{24}$, $R_{25}$, $R_{26}$, $Y_1$, $L_3$, $Z_7$, etc.

In formula (I), Q represents a divalent linking group composed of an atom or an atomic group containing at least one of a carbon atom, a nitrogen atom, a sulfur atom, and an oxygen atom. Q preferably represents a divalent linking group having 4 to 20 carbon atoms composed of one or more of an alkylene group having 1 to 8 carbon atoms (e.g., methylene, ethylene, propylene, butylene or pentylene), an arylene group having 6 to 12 carbon atoms (e.g., phenylene or naphthylene), an alkenylene group having 2 to 8 carbon atoms (e.g., ethynylene or propenylene), an amido group, an ester group, a sulfonamide group, a sulfonic ester group, a ureido group, a sulfonyl group, a sulfinyl group, a thioether group, an ether group, a carbonyl group, $-N(R_0)-$ (wherein $R_0$ represents a hydrogen atom, a substituted or unsubstituted alkyl group or a substituted or unsubstituted aryl group), and a heterocyclic divalent group (e.g., 6-chloro-1,3,5-triazin-2,4-diyl, pyrimidin-2,4-diyl or quinoxalin-2,3-diyl). A ureido group, an ester group, and an amido group are still preferred.

k1 and k3 each preferably represent 1 or 2. It is still preferable that k1, k2, and k3 are all 1. Where k1 or k3 is 2 or more, the plural Hy moieties or Het moieties may be the same or different.

Among the compounds represented by formula (I) those represented by formulae (XI) to (XV) are preferred.

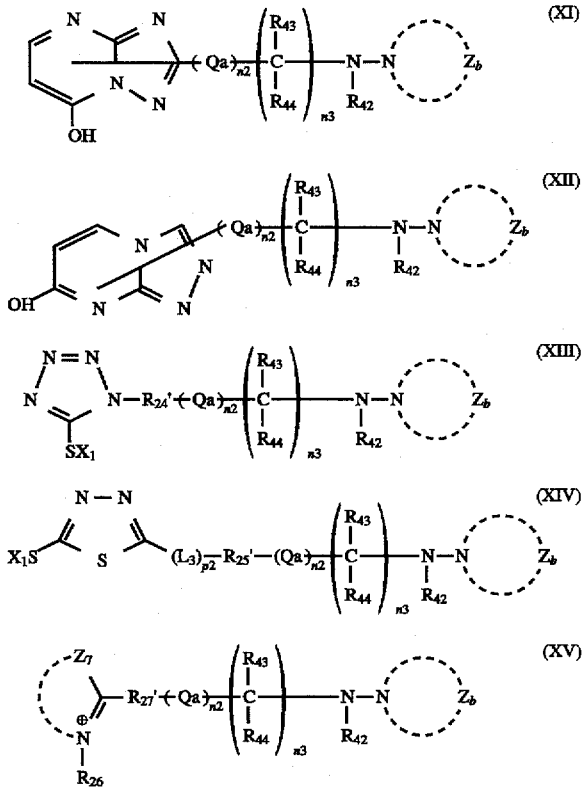

(XI)

(XII)

(XIII)

(XIV)

(XV)

Particularly preferred compounds are those represented by formula (XVI):

(XVI)

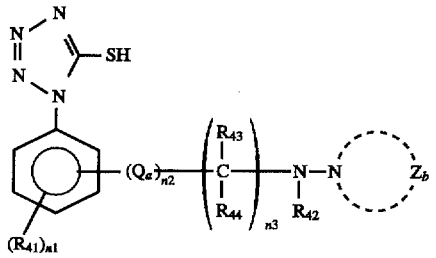

In formulae (XI) to (XVI), Qa has the same meaning as Q; Zb has the same meaning as $Z_1$; $R_{41}$ represents a monovalent substituent; $R_{42}$ represents an aliphatic group, an aryl group or a heterocyclic group; $R_{43}$ and $R_{44}$ each represent a hydrogen atom or a monovalent substituent; n1 represents 0 or an integer of 1 to 4; n2 represents 0 or 1; n3 represents an integer of 1 to 6; where n1 or n3 is 2 or more, the plural $R_{41}$ or $C(R_{43})(R_{44})$ do not need to be the same; $p_2$ represents an integer of 0 or more; $R_{24}'$ and $R_{25}'$ each represent an alkylene group, an arylene group or a divalent heterocyclic group; and $R_{27}'$ represents an alkylene group.

More specifically, Qa preferably includes those mentioned above as preferred examples of Q and still preferably a ureido group, an ester group or an amido group.

Zb preferably includes those mentioned above as preferred examples of $Z_1$ and still preferably an unsubstituted tetramethylene or pentamethylene group.

$R_{41}$ preferably has the same meaning as $R_{42}$ preferably has the same meaning as $R_1$, $R_2$, $R_3$ and $R_4$, and still preferably represents an unsubstituted alkyl group having 1 to 4 carbon atoms (e.g., methyl or ethyl).

$R_{43}$ and $R_{44}$ each preferably have the same meaning as $R_{11}$, and still preferably represents a hydrogen atom.

n2 is preferably 1.

n3 is preferably 2 to 4.

Typical examples of the compounds according to the present invention are shown below for illustrative purposes but not for limitation.

(1)

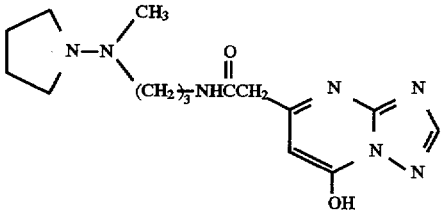

(2)

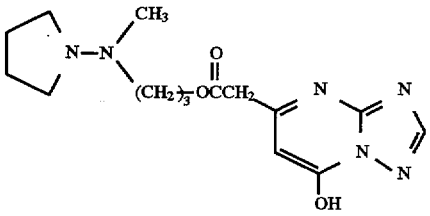

(3)

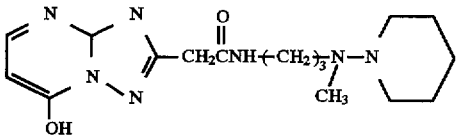

-continued (4)

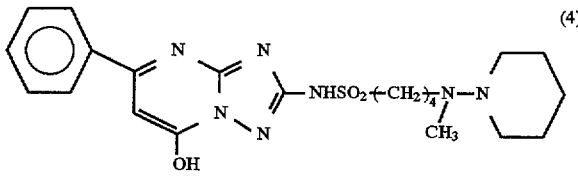

(5)

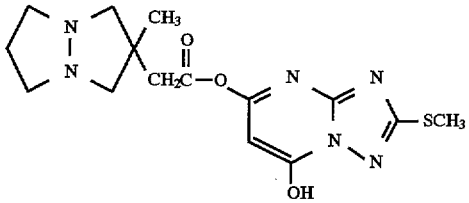

(6)

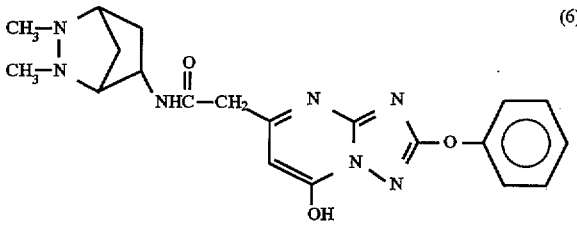

(7)

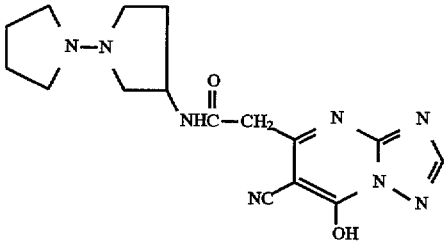

(8)

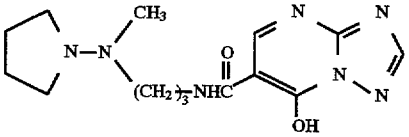

(9)

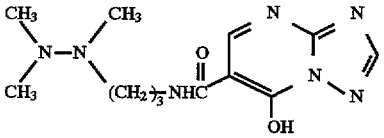

(10)

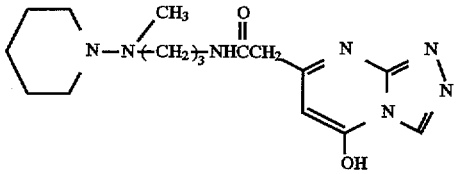

(11)

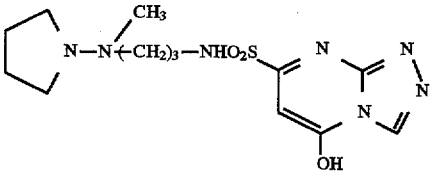

-continued
(12)
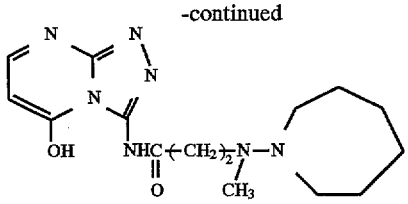
(13)
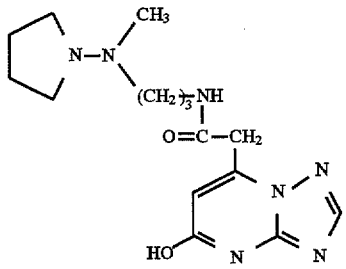
(14)
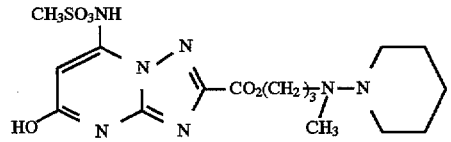
(15)
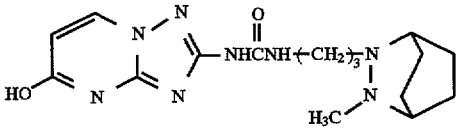
(16)
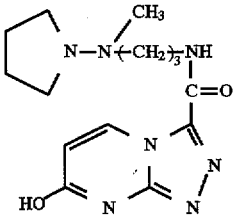
(17)
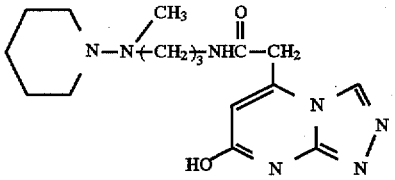
(18)
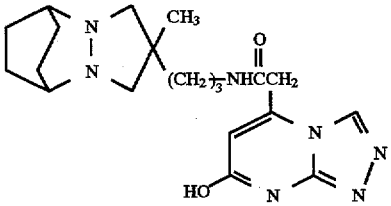
(19)
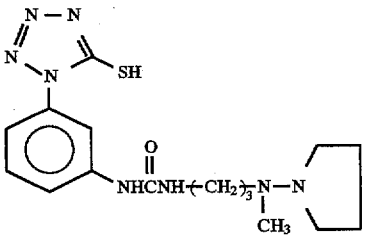
-continued
(20)
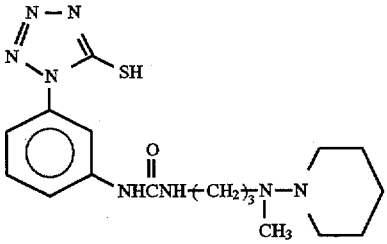
(21)
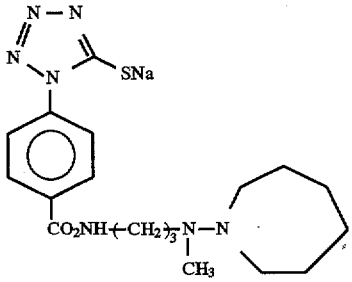
(22)
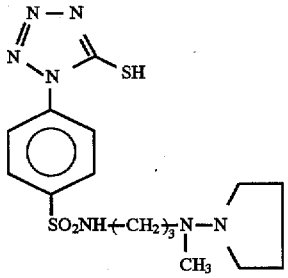
(23)
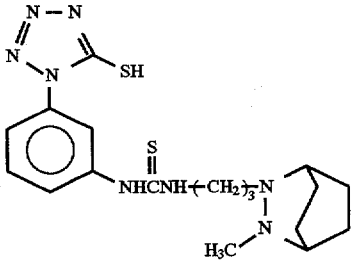
(24)
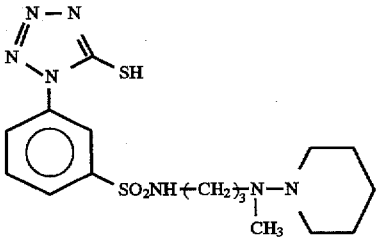
(25)
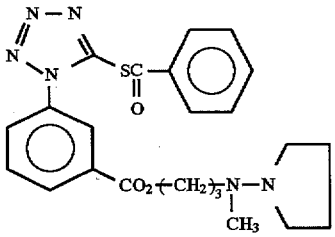

-continued
(26)
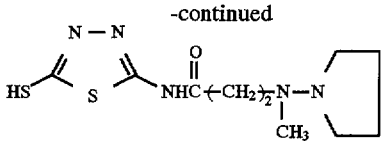
(27)
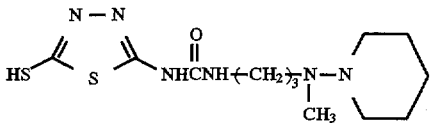
(28)
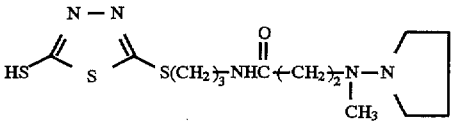
(29)
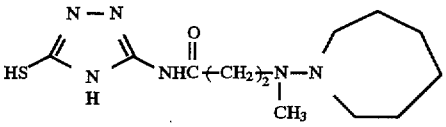
(30)
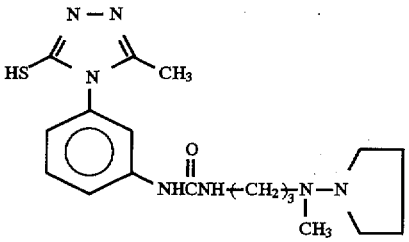
(31)
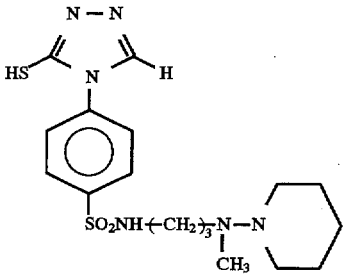
(32)
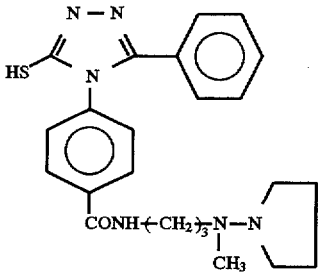
(33)
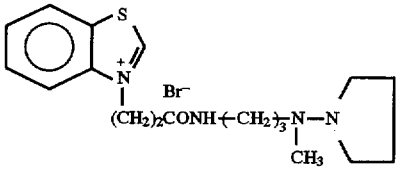
(34)
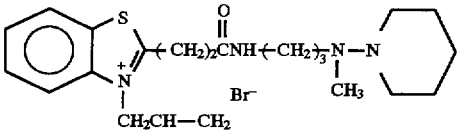
-continued
(35)
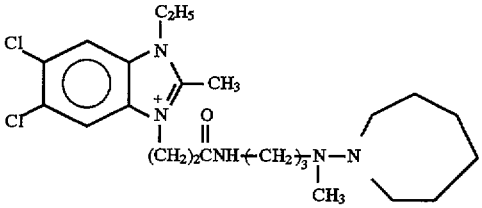
(36)
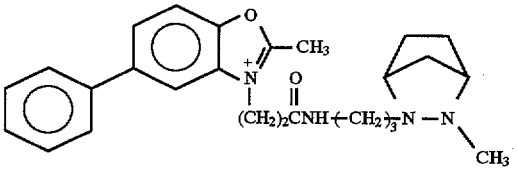
(37)
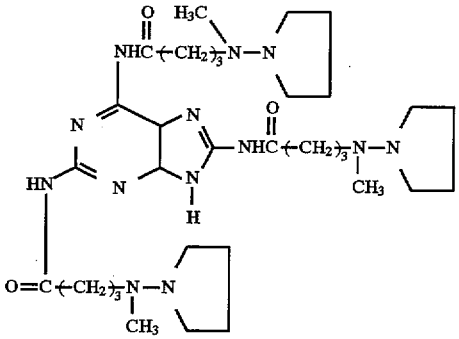
(38)
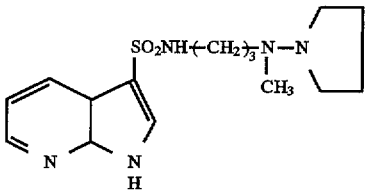
(39)
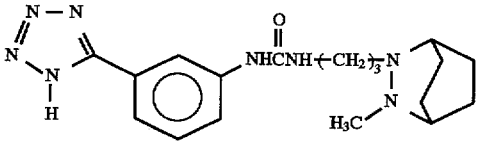
(40)
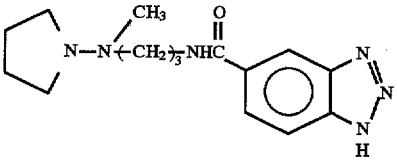
(41)
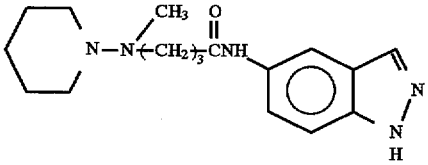
(42)
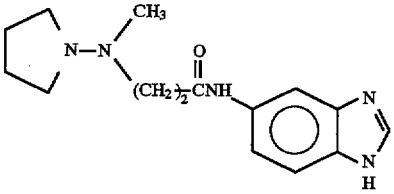

-continued (43)

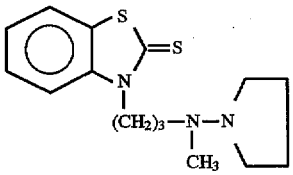

(44)

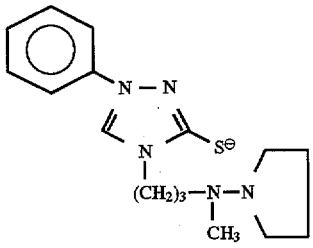

(45)

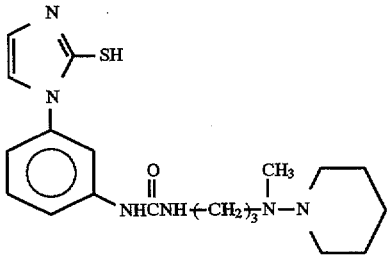

(46)

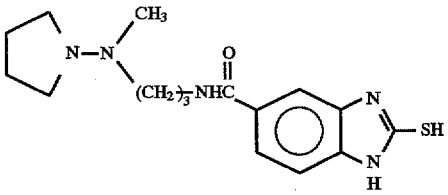

(47)

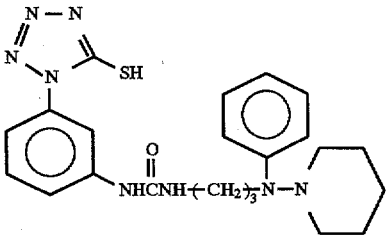

(48)

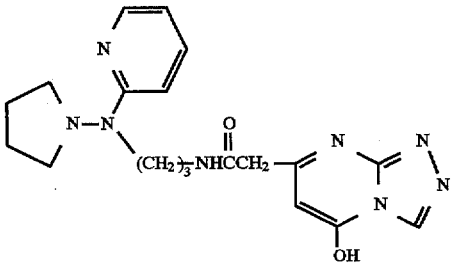

The Het moiety in formula (I) is described in the following publications and can be synthesized by referring to the processes disclosed therein: U.S. Pat. No. 3,266,897, Belgian patent 671,402, JP-A-60-138548 (the term "JP-A" as used herein means an "unexamined published Japanese patent application"), JP-A-59-68732, JP-A-59-123838, JP-B-58-9939, JP-A-59-137951, JP-A-57-202531, JP-A-57-164734, JP-A-57-14836, JP-A-57-116340, U.S. Pat. No. 4,418,140, JP-A-58-95728, JP-A-55-79436, OLS 2,205,029, OLS 1,962,605, JP-A-55-59463, JP-B-48-18257, JP-B-53-28084, JP-A-53-48723, JP-B-59-52414, JP-A-58-217928, JP-B-49-8334, U.S. Pat. Nos. 3,598,602 and 887,009, British Patent 965,047, Belgian Patent 737809, U.S. Pat. No. 3,622,340, JP-A-60-87322, JP-A-57-211142, JP-A-58-158631, JP-A-59-15240, U.S. Pat. No. 3,671,255, JP-B-48-34166, JP-B-48-322112, JP-A-58-221839, JP-B-48-32367, JP-A-60-130731, JP-A-60-122936, JP-A-60-117240, U.S. Pat. No. 3,228,770, JP-A-43-13496, JP-A-43-10256, JP-B-47-8725, JP-B-47-30206, JP-B-47-4417, JP-B-51-25340, British Patent 1,165,075, U.S. Pat. Nos. 3,512,982 and 1,472,845, JP-B-39-22067, JP-B-39-22068, U.S. Pat. Nos. 3,148,067, 3,759,901, and 3,909,268, JP-B-50-40665, JP-B-39-2829, U.S. Pat. No. 3,148,066, JP-B-45-22190, U.S. Pat. No. 1,399,449, British Patent 1,287,284, U.S. Pat. Nos. 3,900,321, 3,655,391, and 3,910,792, British Patent 1,064,805, U.S. Pat. Nos. 3,544,336 and 4,003,746, British Patents 1,344,525 and 972,211, JP-B-43-4136, U.S. Pat. No. 3,140,178, French patent 2,015,456, U.S. Pat. No. 3,114,637, Belgian Patent 681,359, U.S. Pat. No. 3,220,839, British Patent 1,290,868, U.S. Pat. Nos. 3,137,578, 3,420,670, 2,759,908, and 3,622,340, OLS 2,501,261, DAS 1,772,424, U.S. Pat. No. 3,157,509, French Patent 1,351,234, U.S. Pat. No. 3,630,745, French Patent 2,005,204, German Patent 1,447,796, U.S. Pat. No. 3,915,710, JP-B-49-8334, British Patents 1,021,199 and 919,061, JP-B-46-17513, U.S. Pat. No. 3,202,512, OLS 2,553,127, JP-A-50-104927, French patent 1,467,510, U.S. Pat. Nos. 3,449,126, 3,503,936, and 3,576,638, French Patent 2,093,209, British Patent 1,246,311, U.S. Pat. Nos. 3,844,788 and 3,535,115, British Patent 1,161,264, U.S. Pat. Nos. 3,841,878 and 3,615,616, JP-A-48-39039, British Patent 1,249,077, JP-B-48-34166, U.S. Pat. No. 3,671,255, British Patent 1,459,160, JP-A-50-6323, British Patent 1,402,819, OLS 2,031,314, *Research Disclosure* No. 13651, U.S. Pat. Nos. 3,910,791, 3,954,478, and 3,813,249, British Patent 1,387,654, JP-A-57-135945, JP-A-57-96331, JP-A-57-22234, JP-A-59-26731, OLS 2,217,153, British Patents 1,394,371, 1,308,777, 1,389,089, and 1,347,544, German Patent 1,107,508, U.S. Pat. No. 3,386,831, British Patent 1,129,623, JP-A-49-14120, JP-B-46-34675, JP-A-50-43923, U.S. Pat. No. 3,642,481, British Patent 1,269,268, U.S. Pat. Nos. 3,128,185, 3,295,981, 3,396,023, and 2,895,827, JP-B-48-38418, JP-A-48-47335, JP-A-50-87028, U.S. Pat. Nos. 3,236,652 and 3,443,951, British Patent 1,065,669, U.S. Pat. Nos. 3,312,552, 3,310,405, and 3,300,312, British Patents 952,162 and 948,442, JP-A-49-120628, JP-B-48-35372, JP-B-47-5315, JP-B-39-18706, JP-B-43-4941, and JP-A-59-34530.

The Hy moiety in formula (I) can be synthesized through various processes, for example, alkylation of a hydrazine. Known applicable alkylation techniques include substitution using an alkyl halide and an alkyl sulfonate, reductive alkylation using a carbonyl compound and sodium cyanoborohydride, and acylation followed by reduction using lithium aluminum hydride. For the details, refer to S. R. Sandler and W. Karo, *Organic Fanctional Group reparation,* No. 1, Ch. 14, pp. 434–465, Academic Press (1968) and E. L. Clennan, et al., *Journal of The American Chemical Society*, Vol. 112, No. 13, p. 5080 (1990).

Bond-forming reactions for bonding the —$(Q)_{k2}$—(HY) moiety, such as an amido bond formation reaction and an ester bond formation reaction, can be performed by utilizing an appropriately selected process known in organic chemistry, for example, a process of linking Het and Hy, a process comprising first linking Hy to a starting compound or an intermediate for synthesizing Het and then synthesizing Het, or a process comprising first linking a starting compound or an intermediate for synthesizing Hy to Het and then synthesizing Hy. For the details of these linking reactions, reference can be made to extensive literature on organic synthesis, for example, Nihon Kagakukai (ed.), *Shin-Jikken Kagaku Koza* 14, *"Yuki Kagobutsu no Gosei to Hah-no,* Vols. I–V, Maruzen, Tokyo (1977), Ogata Yoshiro, *Yuki Han-no ron*, Maruzen, Tokyo (1962), L. F. Fieser and M. Fieser, *Advanced Organic Chemistry,* Maruzen, Tokyo (1962). Specifically, the compounds of the present invention can be synthesized in accordance with the process described in Examples 1 and 2 of JP-A-7-134351.

In the present invention, spectral sensitizing dyes are preferably used. Any kinds of dyes hitherto known in the art, such as cyanine dyes, merocyanine dyes, rhodacyanine dyes, oxonol dyes, hemicyanine dyes, benzylidene dyes, xanthene dyes, and styril dyes, can be used. Examples of useful dyes are described, e.g., in T. H. James, *The Theory of the Photographic Process,* 3rd Ed., pp. 198–228, Macmillan (1966). The dyes disclosed in JP-A-5-216152, which are represented by formulae (XI), (XII) and (XIII), are preferred. The specific examples described there are still preferred. Of the dyes disclosed, oxacarbocyanine dyes are particularly preferred.

The compound of formula (I) and a sensitizing dye can be incorporated into a silver halide emulsion either by directly dispersing in an emulsion, or once dissolving in a solvent or mixed solvent (e.g., water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, or a mixture thereof) and adding the solution to the emulsion.

Additionally, incorporation may be carried out by a method comprising dissolving a dye, etc. in an volatile organic solvent, dispersing the solution in water or hydrophilic colloid, and adding the dispersion to an emulsion, as described in U.S. Pat. No. 3,469,987; a method comprising directly dispersing a water-insoluble dye, etc. in a water-soluble solvent and adding the dispersion to an emulsion, as disclosed in JP-B-46-24185; a method comprising dissolving a dye in an acid and adding the solution to an emulsion, or a method comprising dissolving a dye in water in the presence of an acid or a base and adding the aqueous solution to an emulsion, as disclosed in JP-B-44-23389, JP-B-44-27555, and JP-B-57-22091; a method comprising dissolving or dispersing a dye in the presence of a surface active agent to prepare an aqueous solution or a colloidal dispersion and adding it to an emulsion, as described in U.S. Pat. Nos. 3,822,135 and 4,006,026; a method comprising directly dispersing a dye, etc. in hydrophilic colloid and adding the dispersion to an emulsion, as described in JP-A-53-102733 and JP-A-58-105141; and a method comprising dissolving a dye using a compound capable of causing a redox reaction and adding the solution to an emulsion, as described in JP-A-51-74624.

Ultrasonic waves may be made use of for dissolving the compound of formula (I) or the sensitizing dye.

The sensitizing dye or the compound of formula (I) can be added to a silver halide emulsion at any stage of preparation of the emulsion which has been admitted to be suitable for the addition. For instance, they may be added during silver halide grain formation and/or before desalting, during desalting and/or in any stage after desalting and before the start of chemical ripening as suggested in U.S. Pat. Nos. 2,735,766, 3,628,960, 4,183,756, and 4,225,666, JP-A-58-184142, JP-A-60-196744; or immediately before and during chemical ripening and in any stage after chemical ripening and before application of the emulsion, as described in JP-A-58-113920. Further, a compound either alone or in combination with a structurally different compound may be added in divided portions, for example, once during grain formation and then during chemical ripening or after completion of chemical ripening, or once before or during chemical ripening and then after completion of chemical ripening. The kind of the compound added or the combination of the compounds added may be changed for each addition.

The sensitizing dyes are used in an amount of $4\times10^{-8}$ to $8\times10^{-2}$ mol per mole of silver halide, while varying depending on the shape and size of silver halide grains.

The time of addition of the compounds of formula (I) may be either before or after addition of sensitizing dyes. The compounds of formula (I) are each preferably added in an amount of $1\times10^{-9}$ to $5\times10^{-1}$ mol, still preferably $1\times10^{-8}$ to $2\times10^{-2}$ mol, per mole of silver halide.

While sensitizing dyes and the compounds (I) may be added at any molar ratio, a preferred molar ratio of sensitizing dye/compound (I) ranges from 1000/1 to 1/1000, particularly 100/1 to 1/10.

The silver halide emulsion may further contain, in addition to sensitizing dyes, dyes or substances which have no spectral sensitizing action by themselves or do not substantially absorb visible light but exhibit a supersensitizing action. Such supersensitizing dyes or substances include aminostyryl compounds substituted with a nitrogen-containing heterocyclic ring (e.g., the compounds described in U.S. Pat. Nos. 2,933,390 and 3,635,721), aromatic organic acid-formaldehyde condensates (e.g., the compounds described in U.S. Pat. Nos. 3,743,510), cadmium salts, and azaindene compounds. Combinations described in U.S. Pat. Nos. 3,615,613, 3,615,641, 3,617,295, and 3,635,721 are especially useful.

Preparation of silver halide emulsions is roughly divided into grain formation, desalting, and chemical sensitization, etc. Grain formation is further divided into nucleation, ripening, and growth. These steps are not always carried out in a decided manner, i.e., the order of the steps may be reversed, and some steps may be repeatedly conducted. Reduction sensitization of a silver halide emulsion may be effected, in principle, at any stage. That is, it may be carried out in the initial stage of grain formation, i.e., at the nucleation step, or at the physical ripening or growth step, or it may either precede or follow other chemical sensitization. Where gold sensitization is conducted in combination, it is recommended to carry out reduction sensitization before gold sensitization so as not to cause unfavorable fog. Reduction sensitization during growth of silver halide grains is especially recommended. The expression "during growth" as used herein is meant to include not only an embodiment in which silver halide grains are subjected to reduction sensitization while they are growing through physical ripening or under addition of a water-soluble silver salt and a water-soluble alkali halide but an embodiment in which growth of the grains is temporarily stopped to conduct reduction sensitization, followed by continuation of the grain growth.

The reduction sensitization according to the present invention can be carried out by addition of a known reducing sensitizer to a silver halide emulsion; or allowing silver halide grains to grow or ripe in a low pAg atmosphere (pAg: 1 to 7), called silver ripening, or in a high pH atmosphere (pH: 8 to 11); or a combination of two or more of these techniques.

The method consisting of addition of a reducing sensitizer is advantageous in that the level of reduction sensitization can be finely controlled.

The reducing sensitizers which can be used in the present invention are selected from known reducing sensitizers, such as stannous salts, amines, polyamic acids, hydrazine derivatives, formamidinesulfinic acids, silane compounds, and borane compounds. Two or more of these compounds may be used as a combination. Preferred of them are stannous chloride, thiourea dioxide, and dimetylamine-borane. The amount of reducing sensitizers to be added should be decided according to the conditions of emulsion preparation, and usually ranges $1\times10^{-7}$ to $1\times10^{-3}$ mol per mole of silver halide.

Ascorbic acid and derivatives thereof (hereinafter inclusively referred to as ascorbic acid compounds) are also useful as reducing sensitizers. Examples of ascorbic acid compounds useful as reducing sensitizers are shown below.

(A-1) L-Ascorbic acid
(A-2) Sodium L-ascorbate
(A-3) Potassium L-ascorbate
(A-4) DL-Ascorbic acid
(A-5) Sodium D-ascorbate
(A-6) L-Ascorbic acid 6-acetate
(A-7) L-Ascorbic acid 6-palmitate
(A-8) L-Ascorbic acid 6-benzoate
(A-9) L-Ascorbic acid 5,6-diacetate
(A-10) L-Ascorbic acid 5,6-o-isopropylidene It is desirable to use the ascorbic acid compound in an amount larger than what has been recommended for conventional reducing sensitizers. For example, JP-B-57-33572 reads "The amount of a reducing agent should not exceed $0.75\times10^{-2}$ milliequivalent (corresponding to $8\times10^{-4}$ mol per mole of AgX, as calculated by the inventors of the present invention). In many cases, the range 0.1 to 10 mg per kg of silver nitrate (corresponding to $1\times10^{-7}$ to $1\times10^{-5}$ mol per mole of AgX, as calculated by the present inventors) is effective.". U.S. Pat. No. 2,487,850 describes that a tin compound as a reducing sensitizer can be used in an amount ranging from $1\times10^{-7}$ to $44\times10^{-6}$ mol. Further, JP-A-57-179835 mentions that thiourea dioxide and stannous chloride are suitably used in an amount of about 0.01 mg to about 2 mg and about 0.01 mg to about 3 mg, respectively, per mole of silver halide. In the present invention, the ascorbic acid compound is preferably used in an amount of from $5\times10^{-5}$ to $1\times10^{-1}$ mol, still preferably from $5\times10^{-4}$ to $1\times10^{-2}$ mol, and particularly preferably from $1\times10^{-3}$ to $1\times10^{-2}$ mol, per mole of silver halide, while varying depending on the size and halogen composition of emulsion grains and the temperature, pH, pAg or the like conditions of emulsion preparation.

The reducing sensitizer may be dissolved in an appropriate solvent, such as an alcohol, a glycol, a ketone, an ester or an amide, and added to an emulsion during grain formation or before or after chemical sensitization, It is particularly preferred to add the reducing sensitizer during grain growth. In this case, the reducing sensitizer may previously be put into a reaction vessel but is preferably added to the grain formation system. It is also possible to previously add the reducing sensitizer to a water-soluble silver salt or a water-soluble alkali halide which are to be added for grain growth. It is another preferred embodiment that a solution of a reducing sensitizer is added over a long period of time either intermittently or continuously in conformity with the grain growth.

It is preferable to use an oxidizing agent for silver during the emulsion preparation. The term "oxidizing agent for silver" means a compound capable of acting on metallic silver to convert it to silver ions. A compound capable of converting extremely fine silver particles by-produced in grain formation and chemical sensitization steps into silver ions is particularly effective. The silver ions thus produced may form a sparingly water-soluble silver salt, such as silver halides, silver nitride or silver selenide, or an easily water-soluble silver salt, such as silver nitrate. The oxidizing agent for silver may be either organic or inorganic. Inorganic oxidizing agents include ozone, hydrogen peroxide and adducts thereof (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salts ($K_2S_2O_8$, $K_2C_2O_6$, and $K_2P_2O_8$), peroxy complex compounds (e.g., $K_2[Ti(O_2)C_2O_4].3H_2O$, $4K_2SO_4.Ti(O)_2OH.SO_4.2H_2O$, $Na_3[VO(O_2)(C_2H_4)_2].6H_2$), oxyacid salts, such as permanganates (e.g., $KMnO_4$) and chromic acid salts (e.g., $K_2Cr_2O_7$), halogen elements (e.g., iodine and bromine), perhalogenic acid salts (e.g., potassium periodate), salts of metals of high valency (e.g., potassium hexacyanoferrate), and thiosulfonic acid salts. Organic oxidizing agents include quinones, such as p-quinone; peroxides, such as peracetic acid and perbenzoic acid; and compounds releasing an active halogen, such as N-bromosuccinimide, chloramine T, and chloramine B.

Of these oxidizing agents, preferred in the present invention are organic oxidizing agents, such as quinones; and inorganic oxidizing agents, such as ozone, hydrogen peroxide and adducts thereof, halogen elements, and thiosulfinates. It is a preferred embodiment to combine the above-mentioned reduction sensitization and use of the oxidizing agent. For example, reduction sensitization can be preceded by the use of the oxidizing agent, or vice versa, or a reducing sensitizer and the oxidizing agent are used at the same time. These treatments can be carried out in any of a grain growth step or a chemical sensitization steps.

Particularly preferred oxidizing agents are selected from compounds represented by formulae (XX) to (XXII):

$$R_{101}—SO_2S—M_{101} \quad (XX)$$

$$R_{101}—SO_2S—R_{101} \quad (XXI)$$

$$R_{101}—SO_2S—(E)_aSSO_2—R_{103} \quad (XXII)$$

wherein $R_{101}$, $R_{102}$, and $R_{103}$ each represent an aliphatic group, an aryl group or a heterocyclic group; $M_{101}$ represents a cation; E represents a divalent linking group; and a represents 0 or 1.

The aliphatic group for $R_{101}$, $R_{102}$ or $R_{103}$ preferably includes a substituted or unsubstituted alkyl group having 1 to 22 carbon atoms (e.g., methyl, ethyl, propyl, butyl, pentyl, hexyl, octyl, 2-ethylhexyl, decyl, dodecyl, hexadecyl, octadecyl, cyclohexyl, isopropyl and t-butyl), a substituted or unsubstituted alkenyl group having 2 to 22 carbon atoms (e.g., allyl or butenyl) or a substituted or unsubstituted alkynyl group having 2 to 22 carbon atoms (e.g., propargyl or butynyl).

The aryl group for $R_{101}$, $R_{102}$ or $R_{103}$ preferably contains 6 to 20 carbon atoms and includes a phenyl group and a naphthyl group, each of which may be substituted.

The heterocyclic group for $R_{101}$, $R_{102}$ or $R_{103}$ includes 3- to 15-membered ring containing at least one hetero atom selected from nitrogen, oxygen, sulfur, selenium, and tellurium. Examples of such heterocyclic groups are pyrrolidine, piperidine, pyridine, tetrahydrofuran, thiophene, oxazole, thiazole, imidazole, benzothiazole, benzoxazole, benzimidazole, selenazole, benzoselenazole, tetrazole, triazole, benzotriazole, oxadiazole, and thiadiazole rings.

Substituents which may be on $R_{101}$, $R_{102}$ or $R_{103}$ include an alkyl group (e.g., methyl, ethyl or hexyl), an alkoxy group (e.g., methoxy, ethoxy or octyloxy), an aryl group (phenyl, naphthyl or tolyl), a hydroxyl group, a halogen atom (e.g., fluorine, chlorine, bromine or iodine), an aryloxy group (e.g., phenoxy), an alkylthio group (e.g., methylthio or butylthio), an arylthio group (e.g., phenylthio), an acyl group (e.g., acetyl, propionyl, butyryl or valeryl), a sulfonyl group (e.g., methylsulfonyl or phenylsulfonyl), an acylamino group (e.g., acetylamino or benzamino), a sulfonylamino group (e.g., methaneuslfonylamino or benzenesulfonylamino), an acyloxy group (e.g., acetoxy or benzoxy), a carboxyl group, a cyano group, a sulfo group, and an amino group.

E preferably represents a divalent aliphatic group or a divalent aromatic group. The divalent aliphatic group as E includes $-(CH_2)_n-$ (n=1 to 12), $-CH_2-CH=CH-CH_2-$,

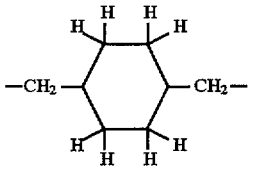

$-CH_2C\equiv C-H_2-$, and a xylylene group; and the divalent aromatic group as E includes a phenylene group and a naphthylene group. These groups may have substituents, such as $R_1$, $R_2$, $R_3$, $R_4$, and substituents V.

$M_{101}$ preferably represents a metallic ion or an organic cation. The metallic ion includes a lithium ion, a sodium ion, and a potassium ion, and the organic cation includes an ammonium ion (e.g., ammonium, tetramethylammonium or tetrabutylammonium), a phosphonium ion (e.g., tetraphenylphosphonium), and a guanidine group.

Specific but non-limiting examples of the compounds represented by formulae (XX) to (XXII) are shown below.

$CH_3SO_2SNa$ (XX-1)

$C_2H_5CO_2SNa$ (XX-2)

$C_3H_7SO_2SK$ (XX-3)

$C_4H_9SO_2SLi$ (XX-4)

$C_6H_{13}SO_2SNa$ (XX-5)

$C_8H_{17}SO_2SNa$ (XX-6)

$CH_3(CH_2)_3CH(C_2H_5)CH_2SO_2S.NH_4$ (XX-7)

$C_{10}H_{21}SO_2SNa$ (XX-8)

$C_{12}H_{25}SO_2SNa$ (XX-9)

$C_{16}H_{33}SO_2SNa$ (XX-10)

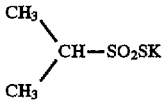

(XX-11)

$t\text{-}C_4H_9SO_2SNa$ (XX-12)

$CH_3OCH_2CH_2SO_2S.Na$ (XX-13)

-continued

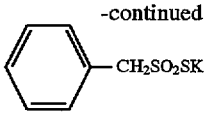

(XX-14)

$CH_2=CHCH_2SO_2SNa$ (XX-15)

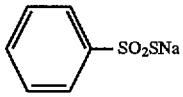

(XX-16)

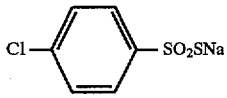

(XX-17)

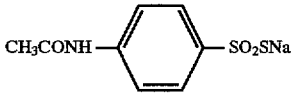

(XX-18)

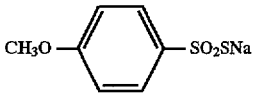

(XX-19)

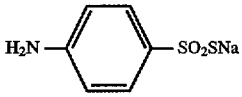

(XX-20)

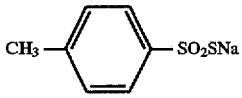

(XX-21)

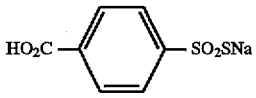

(XX-22)

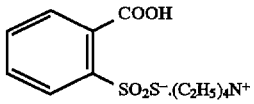

(XX-23)

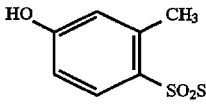

(XX-24)

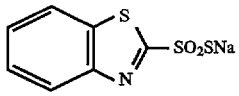

(XX-25)

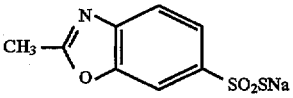

(XX-26)

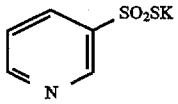

(XX-27)

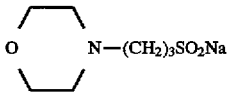

(XX-28)

$KSSO_2(CH_2)_2SO_2SK$ (XX-29)

$NaSSO_2(CH_2)_4SO_2SNa$ (XX-30)

-continued
$NaSSO_2(CH_2)_4S(CH_2)_4SO_2SNa$ (XX-31)
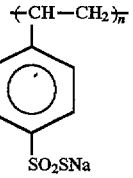
(XX-32)
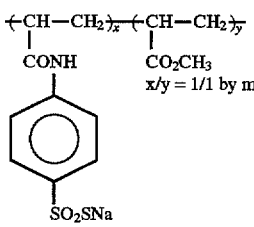
(XX-33)
x/y = 1/1 by mol
$C_2H_5SO_2S-CH_3$ (XXI-1)
$C_8H_{17}SO_2SCH_2CH_3$ (XXI-2)
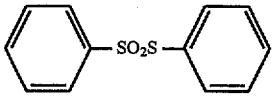
(XXI-3)
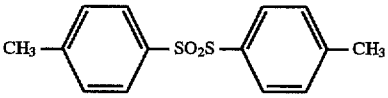
(XXI-4)
$C_2H_5SO_2SCH_2CH_2CN$ (XXI-5)
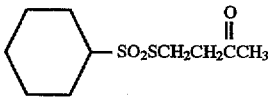
(XXI-6)
$C_4H_9SO_2SCH(CH_3)CH_2CN$ (XXI-7)
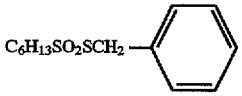
(XXI-8)
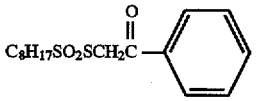
(XXI-9)
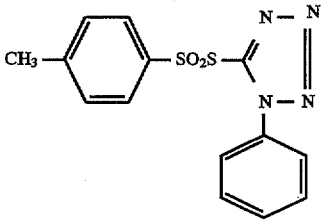
(XXI-10)
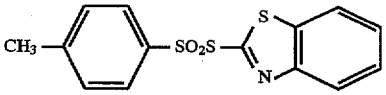
(XXI-11)
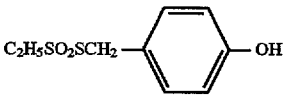
(XXI-12)
-continued
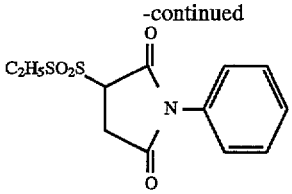
(XXI-13)
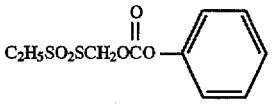
(XXI-14)
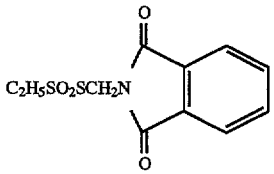
(XXI-15)
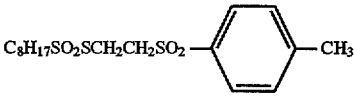
(XXI-16)
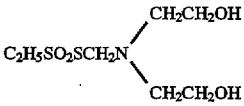
(XXI-17)
$C_2H_5SO_2SCH_2CH_2CH_2CH_2OH$ (XXI-18)
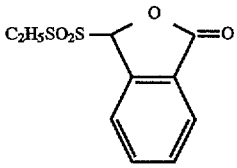
(XXI-19)
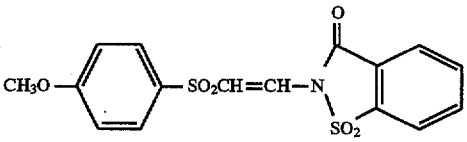
(XXI-20)
$CH_3SSO_2(CH_2)_4SO_2SCH_3$ (XXI-21)
$CH_3SSO_2(CH_2)_2SO_2SCH_3$ (XXI-22)
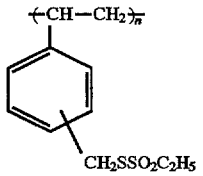
(XXI-23)
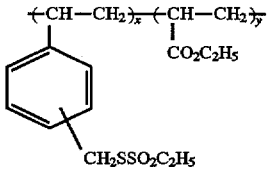
(XXI-24)
x/y = 2/1 by mol
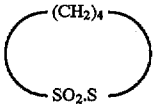
(XXI-25)

-continued

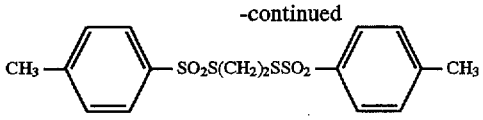

(XXII-1)

$C_2H_5SO_2SCH_2CH_2SO_2CH_2CH_2SSO_2C_2H_5$ (XXII-2)

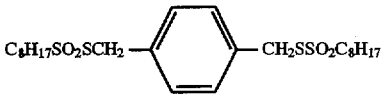

(XXII-3)

$C_2H_5SO_2SCH_2NCH_2CH_2NCH_2SSO_2C_2H_5$ (XXII-4)

$CH_2CH_2OH$ $CH_2CH_2OH$

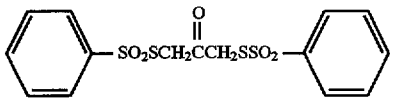

(XXII-5)

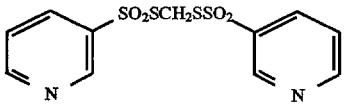

(XXII-6)

$C_2H_5SSSO_2C_2H_5$ (XXII-7)

$(n)C_3H_7SO_2SSSO_2C_3H_7(n)$ (XXII-8)

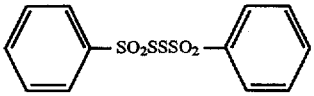

(XXII-9)

The compounds of formula (XX) can easily be synthesized by the process described in JP-A-54-1019 and British Patent 972,211.

The compounds of formulae (XX) to (XXII) are preferably used in an amount of $1\times10^{-7}$ to $1\times10^{-1}$ mol, still preferably $1\times10^{-6}$ to $1\times10^{-2}$ mol, particularly preferably $1\times10^{-5}$ to $1\times10^{-3}$ mol, per mole of silver halide.

Methods commonly used for addition of additives to a photographic emulsion can be applied to the addition of the compounds of formulae (XX) to (XXII) to the emulsion. For example, a water-soluble compound is dissolved in water in an appropriate concentration, while a water-insoluble or sparingly water-soluble compound is dissolved in a water-miscible organic solvent which gives no adverse influences on photographic characteristics and is selected from alcohols, glycols, ketones, esters, amides, and the like, and the resulting solution is added to the emulsion.

The compounds represented by formulae (XX) to (XII) can be added at any stage during grain formation or before and after chemical sensitization. It is recommended to add them during or after reduction sensitization, and particularly during grain growth. In this case, the compound may previously be put into a reaction vessel but is preferably added to the grain formation system at an appropriate stage. It is also possible to previously add the compound to a water-soluble silver salt or a water-soluble alkali halide which are to be added for grain formation. It is another preferred embodiment that a solution of the compound is added over a long period of time either intermittently or continuously in conformity with the grain formation.

Of the compounds represented by formulae (XX) to (XXII) the compounds of formula (XX) are particularly preferred.

The silver halide emulsion of the present invention is preferably sensitized by gold-chalcogen sensitization. Chalcogen sensitization is generally carried out with at least one of selenium sensitizers, sulfur sensitizers, and tellurium sensitizers.

Selenium sensitization can be carried out in a conventional manner. That is, it is usually performed by adding a labile selenium compound and/or a non-labile selenium compound to an emulsion and stirring the emulsion for a given period of time at a high temperature, preferably 40° C. or higher. Selenium sensitization using the labile selenium sensitizers described in JP-B-44-15748 is preferably adopted. Specific examples of the labile selenium sensitizers are aliphatic isoselenocyanates, such as allyl isoselenocyanate, selenoureas, selenoketones, selenoamides, selenocarboxylic acids and their esters, and selenophosphates. Particularly preferred labile selenium compounds are shown below.

I. Colloidal metallic selenium

II. Organoselenium compounds (organic compounds with a selenium atom bonded to the carbon atom thereof via a covalent double bond):

a. Isoselenocyanates, such as aliphatic isoselenocyanates, e.g., allyl isoselenocyanate.

b. Selenoureas (inclusive of enol type compounds), such as aliphatic selenoureas containing an aliphatic group, e.g., methyl, ethyl, propyl, isopropyl, butyl, hexyl, octyl, dioctyl, tetramethyl, N-(β-carboxyethyl)-N',N'-dimethyl, N,N-dimethyl, diethyl or dimethyl; aromatic selenoureas containing one or more aromatic groups, e.g., phenyl or tolyl; and heterocyclic selenoureas containing a heterocyclic group, e.g., pyridyl or benzothiazolyl.

c. Selenoketones, such as selenoacetone, selenoacetophenone, a selenoketone having an alkyl group bonded to >C=Se, and selenobenzophenone.

d. Selenoamides, such as selenoacetamide.

e. Selenocarboxylic acid and esters thereof, such as 2-selenopropionic acid, 3-selenobutyric acid, and methyl 3-selenobutyrate.

III. Others:

a. Selenides, such as diethyl selenide, diethyl diselenide, and triphenylphosphine selenide.

b. Selenophosphates, such as tri-p-tolyl selenophosphate and tri-n-butyl selenophosphate.

These compounds are preferred types of labile selenium compounds and are by no means limitative. The structure of a labile selenium compound as a sensitizer for photographic emulsions is not so important as long as the selenium atom is labile in the structure. It is generally accepted that the organic moiety of a selenium sensitizer molecule serves for nothing but as a support for selenium to make it exist in an emulsion in an instable form. In the present invention, labile selenium compounds included in such a broad sense are used to advantage.

Selenium sensitization using a non-labile selenium sensitizer as described in JP-B-46-4553, JP-B-52-34492 and JP-B-52-34491 is also employable. Useful non-labile selenium compounds include selenious acid, potassium selenocyanide, selenazole compounds, a quaternary ammonium salt of selenazole compounds, diaryl selenides, diaryl diselenides, 2-thioselenazolidinedione, 2-selenoxozinethione, and derivatives thereof.

The non-labile selenium sensitizers (thioselenazolidinedione compounds) described in JP-B-52-38408 are also effective.

These selenium sensitizers are added to an emulsion at the time of chemical sensitization in the form of a solution in water or an organic solvent, such as methanol or ethanol, or a mixture thereof. They are preferably added before the commencement of chemical sensitization. These selenium sensitizers may be used either individually or in combination of two or more thereof. A combined use of a labile selenium compound and a non-labile selenium compound is preferred.

The amount of the selenium sensitizer to be added varies depending on the activity of the selenium sensitizer, the kind or size of silver halide grains, and the temperature or time of ripening, and is preferably at least $1\times10^{-8}$ mol, still preferably from $1\times10^{-7}$ to $1\times10^{-4}$ mol, per mole of silver halide. In using a selenium sensitizer, the temperature of chemical ripening is preferably not lower than 45° C., still preferably from 50° to 80° C. The pAg and pH are arbitrary. For example, the pH for obtaining desired effects broadly ranges from 4 to 9.

It is effective to perform selenium sensitization in the presence of a silver halide solvent. Silver halide solvents which can be used in the present invention include (a) organic thioethers described, e.g., in U.S. Pat. Nos. 3,271,157, 3,531,289, and 3,574,628, JP-A-54-1019 and JP-A-54-158917, (b) thiourea derivatives described, e.g., in JP-A-53-82408, JP-A-55-77737, JP-A-52-2982, (c) silver halide solvents having a thiocarbonyl group caught between an oxygen atom or a sulfur atom and a nitrogen atom described in JP-A-53-144319, (d) imidazoles described in JP-A-54-100717, (e) sulfites, and (f) thiocyanates. Particularly preferred of them are thiocyanates and tetramethylthiourea. The amount of the silver halide solvent to be used depends on the kind. A thiocyanate, for example, is preferably used in an amount of from $1\times10^{-4}$ to $1\times10^{-2}$ mol per mole of silver halide.

Sulfur sensitization is usually carried out by adding a sulfur sensitizer to an emulsion, followed by stirring for a given period of time at a high temperature, preferably 40° C. or higher.

Gold sensitization is usually performed by adding a gold sensitizer to an emulsion, followed by stirring for a given period of time at a high temperature, preferably 40° C. or higher.

The sulfur sensitization can be effected using any of known sulfur sensitizers, such as thiosulfates, allylthiocarbamidethiourea, allyl isothiocyanate, cystine, p-toluenethiosulfonates, and rhodanine. Additionally, those described in U.S. Pat. Nos. 1,574,944, 2,410,689, 2,278,947, 2,728,668, 3,501,313, and 3,656,955, German Patent 1,422,868, JP-B-56-24937, and JP-A-55-45016 are also useful.

The sulfur sensitizer is added in an amount sufficient to effectively increase the sensitivity of an emulsion. Such an amount varies depending on various conditions, such as pH, temperature, and size of silver halide grains. The amount preferably ranges from $1\times10^{-7}$ to $1\times10^{-4}$ mol per mole of silver halide.

Gold sensitizers which can be used in gold sensitizers are selected from gold compounds generally employed as gold sensitizers, in which the oxidation number of gold may be either +1 or +3. Typical examples of gold sensitizers are chloroaurates, e.g., potassium chloroaurate, auric trichloride, potassium auric thiocyanate, potassium iodoaurate, tetracyanoauric acid, ammonium aurothiocyanate, and pyridyltrichlorogold.

The amount of the gold sensitizer to be added varies according to various conditions. The amount preferably ranges from $1\times10^{-7}$ to $1\times10^{-4}$ mol per mole of silver halide.

Gold-chalcogen sensitization is selected from gold-sulfur sensitization, gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization.

The emulsion according to the present invention preferably comprises tabular silver halide grains having an aspect ratio of 3 or higher, still preferably 5 or higher. The terminology "tabular grains" as used herein is a generic term for crystals having a single twinning plane or two or more parallel twinning planes. In this case, a (111) plane is called a twinning plane, where ions at all the lattice points on one side of that plane and those on the other side are mirror images of each other. The tabular grains have a triangular shape, a hexagonal shape, or a rounded triangular or hexagonal shape (i.e., circular shape) when looked down. Tabular grains having a triangular shape, a hexagonal shape or a circular shape have triangular, hexagonal or circular outer crystal surfaces, respectively, which are parallel to each other.

The term "aspect ratio" as used herein denotes a quotient of a grain diameter divided by a grain thickness as for those tabular grains having a diameter of not smaller than 0.1 μm. The "grain thickness" can easily be obtained by depositing a metal on the grains by oblique vacuum evaporation, measuring the length of the shadow on the electron micrograph, and calculating by reference to the length of the shadow of a similarly treated reference latex.

The "grain diameter" is a diameter of a circle having the same area as the projected area of parallel outer surfaces. The projected area of grains is obtained by measuring the area on the electron micrograph and making a correction for the magnification.

The tabular grains preferably has a diameter of 0.15 to 5.0 μm and a thickness of 0.05 to 1.0 μm.

An average aspect ratio is obtained as a statistical average of the aspect ratios of at least 100 grains. It is also obtainable as a ratio of an average diameter to an average thickness.

The emulsion of the present invention preferably contains tabular silver halide grains having an aspect ratio of 3 or more, still preferably 5 or more. The proportion of such preferred tabular silver halide grains in the total emulsion grains is preferably 60% or more, still preferably 80% or more, in terms of projected area.

Use of a monodispersed tabular grain emulsion sometimes brings about good results. The structure of monodispersed tabular grains and processes for producing such grains are described, e.g., in JP-A-63-151618. Briefly, the terminology "monodispersed tabular grain emulsion" is given to such an emulsion that at least 70%, in terms of projected area, of all the silver halide grains are hexagonal tabular grains having two parallel planes as outer surfaces in which a ratio of the longest side length to the shortest side length is not more than 2 and that the degree of monodispersion is not more than 20% as expressed in terms of a coefficient of size variation of the hexagonal tabular grains, the coefficient of size variation being a ratio of a standard deviation of grain size, in terms of projected area circle-equivalent diameter, to a mean grain size.

The emulsion grains of the present invention preferably have dislocation lines. Dislocations of tabular grains can be observed directly under a transmission electron microscope at a low temperature as described in J. F. Hamilton, *Phot. Sci. Eng.*, Vol. 11, p. 57 (1967) and T. Shiozawa, *J. Soc. Phot. Sci. Japan*, Vol. 35, p. 213 (1972). That is, silver halide grains, taken out from an emulsion with care not to apply such pressure as causes a dislocation, are placed on a mesh for electron microscopic observation and observed with a transmitted electron beam while cooling the grains so as to prevent damages by an electron beam, such as print-out. Since it is harder for a thicker grain to transmit an electron beam, a clearer image could be obtained by using a high voltage electron microscope (accelerating voltage: 200 kV or higher for 0.25 μm thick grains). Observation of the resulting micrograph reveals the location and the number of dislocations for individual grains when seen from the vertical direction with respect to the main plane.

The number of dislocation lines is 10 or more, preferably 20 or more, per grain in average. In case where dislocation lines are densely present or they are found intersecting each other, the number of the dislocation lines per grain cannot be counted accurately. Even in these cases, it is possible to obtain approximate figures like about 10, 20 or 30, making a distinction from the case where there are obviously a few lines. An average number of dislocation lines per grain is obtained by making a count for at least 100 grains.

Dislocation lines can be introduced into, for example, the peripheral portion of tabular grains. In this case, dislocations are almost perpendicular to the periphery, and each dislocation line initiates from the position x% distant from the center of a tabular grain toward the side (periphery). The value x is preferably 10 or greater and less than 100, still preferably 30 or greater and less than 99, particularly preferably 50 or greater and less than 98. The figure formed by linking the positions where individual dislocations initiate is nearly similar to the grain shape and sometimes distorted from a similar figure. Dislocations of this type do not appear in the central portion of grains. The directions of the dislocation lines are in most cases crystallographically approximate to a (211) direction, but often wind and sometimes intersect each other.

The dislocation lines may be distributed almost uniformly over the entire peripheral portion of a tabular grain or may be localized on some part of the peripheral portion. In other words, taking hexagonal tabular grains for instance, dislocation lines may be confined to the vicinities of 6 vertices or only one of the vertices. Conversely, dislocation lines may be limited to the sides except 6 vertices.

Dislocation lines may be formed over the portion including the middle of the two predominant planes which are parallel to each other. Where dislocation lines are formed over the entire area of the predominant plane, the directions of some dislocation lines, when seen from the direction perpendicular to the predominant plane, are crystallographically approximate to the (211) direction, and others to the (110) direction or at random. The lengths of the dislocation lines are also at random, so that some are observed as short lines on the predominant plane and some are found as long lines reaching the side (periphery). Some dislocation lines are straight, and others winding. They intersect each other in many cases.

As described above, the positions of dislocations may be on the peripheral portion or the predominant plane, or may be localized, or dislocations may take all these positions in combination. That is, they may be present on both the peripheral portion and the predominant plane.

Introduction of dislocation lines to the peripheral portion of tabular grains can be achieved by providing a specific layer having a high silver iodide content in the inside of the grains (hereinafter referred to as internal high silver iodide layer). The term "high silver iodide layer" includes in its enlarged sense discontinuous areas having a high silver iodide content. An internal high silver iodide layer can be provided by forming a high silver iodide layer on a basic grain and covering the outer surface of the high silver iodide layer with a layer having a lower silver iodide content than the high silver iodide layer. Silver iodide content of the basic grains is lower than that of the internal high silver iodide layer and preferably ranges 0 to 20 mol %, still preferably 0 to 15 mol %.

The internal high silver iodide layer in the inside of grains is a silver iodide-containing silver halide solid solution. The silver halide as referred to herein is preferably silver iodide, silver iodobromide or silver chloroiodobromide. Silver iodide or silver iodobromide having a silver iodide content of 10 to 40 mol % is still preferred. An internal high silver iodide layer can be provided selectively either on the sides or on the vertices of basic grains by controlling the conditions of formation of the basic grains and the conditions of formation of the internal high silver iodide layer. As for the formation of basic grains, a pAg (a logarithm of a reciprocal of a silver ion concentration), presence or absence of a silver halide solvent, the kind and amount of a silver halide solvent, and the temperature are important factors. An internal high silver iodide layer can be formed selectively on the vertices or their vicinities of basic grains by controlling the pAg at 8.5 or lower, preferably 8 or lower, while basic grains are growing. On the other hand, an internal high silver iodide layer can be formed selectively on the sides of basic grains by effecting grain growth at a pAg of higher than 8.5, preferably higher than 9. The threshold values of the pAg vary depending on the temperature, presence or absence of a silver halide solvent, and the kind and amount of a silver halide solvent. In using, for example, a thiocyanate as a silver halide solvent, the above threshold value shifts up. The pAg during grain growth is important especially in the final stage of growth. On the other hand, even if a pAg during growth does not satisfy the above range, it is possible to selectively control the position of an internal high silver iodide layer by adjusting the pAg to the above range after growth of basic grains, followed by ripening. This being the case, it is effective to use ammonia, an amine compound or a thiocyanate as a silver halide solvent. An internal high silver iodide layer can also be formed by a so-called conversion method. Included in this method is a method in which halide ions are added in the course of grain formation, the halide ions added being capable of forming a silver salt whose solubility is lower than that of a salt formed between silver ions and the halide ions forming the grains (or forming the surfaces of the grains and their vicinities) at the time of addition. In the present invention, it is preferable to add halide ions (the silver salt of which has smaller solubility) in an amount higher than a certain halogen composition-related amount per unit surface area of the grains at the time of addition. For example, it is preferable to add potassium iodide in a certain or higher amount per unit surface area of AgBr grains at the time of addition. More specifically, it is preferable to add at least $8.2\times10^{-5}$ mol of an iodide per $m^2$ of the surface area of the grains.

In a still preferred embodiment, an internal high silver iodide layer is formed by adding an aqueous silver salt solution simultaneously with addition of an aqueous solution of a halide containing an iodide. For example, a silver nitrate aqueous solution is added simultaneously with addition of a potassium iodide aqueous solution according to a double jet process. There may be a time lag in starting and completing the addition of the two solutions. The silver nitrate to potassium iodide molar ratio is preferably 0.1 or more, still preferably 0.5 or more, particularly preferably 1 or more. The total molar amount of silver nitrate added may be excess in terms of silver over the halide ions in the system and the iodide ions added. It is preferable to decrease the pAg of the system with time while an iodide-containing silver halide aqueous solution and a silver salt aqueous solution are being added by double jet. That is, the pAg before commencement of addition is preferably 6.5 to 13, still preferably 7.0 to 11, while the pAg on completion of addition is preferably 6.5 to 10.0.

In carrying out the above-mentioned process to form an internal high silver iodide layer, the solubility of the silver halide in the mixed system is preferably as low as possible. Accordingly, the temperature of the mixed system for forming a high silver iodide layer is preferably kept at 30° to 70° C., still preferably 30° to 50° C.

In a best embodiment, an internal high silver iodide layer can be formed by addition of fine grains of silver iodide, silver iodobromide, silver chloroiodide or silver chloroiodobromide. Addition of fine silver iodide grains is especially preferred. These fine grains usually have a grain size of 0.01 to 0.1 μm. Fine grains out of this size range, i.e., less than 0.01 μm or more than 0.1 μm, may also be used. These fine silver halide grains can be prepared by referring to the descriptions of JP-A-l-183417, JP-A-2-44335, JP-A-l-183644, JP-A-l-183645, JP-A-2-43534, and JP-A-2-43535. After addition of the fine silver halide grains, the system is ripened to form an internal high silver iodide layer. The above-mentioned silver halide solvents may be used for dissolving the fine grains to effect ripening. Not all the fine grains added need to rapidly dissolve and disappear. What is required is that all the fine grains added should disappear by the time of completion of final grains.

The outer layer covering the internal high silver iodide layer has a lower silver iodide content than the internal high silver iodide layer, preferably of 0 to 30 mol %, still preferably 0 to 20 mol %, particularly preferably 0 to 10 mol %. The internal high silver iodide layer is preferably provided within an area of not less than 5 mol % and less than 100 mol %, still preferably not less than 20 mol % and less than 95 mol %, and particularly preferably not less than 50 mol % and less than 90 mol %, based on the total silver content as measured from the center of a projected figure, e.g., a hexagonal figure. The amount of silver halide constituting the internal high silver iodide layer is not more than 50 mol %, preferably not more than 20 mol %, in terms of silver, based on the total silver content. These values concerning a high silver iodide layer are not those obtained by actual analyses of the finally obtained grains but those designed for preparing silver halide emulsions. It is a frequent occurrence that internal high silver iodide layers which would have been formed disappear in the finally obtained grains due to recrystallization and the like. It should be understood therefore that all the above description about internal high silver iodide layers concerns the method of preparation.

Accordingly, while dislocation lines can easily be observed in the final grains by the above-mentioned method, cases are often met with, in which internal high silver iodide layers which ought to have been formed for introduction of dislocation lines cannot be confirmed as distinct layers. For example, observation sometimes reveal that all the peripheral portion of tabular grains is comprised of a high silver iodide layer. The halogen composition of the final grains can be confirmed by combining X-ray difractometry, electron prove micro analysis (EPMA, alternatively called XMA; a method of detecting silver halide composition by scanning silver halide grains with an electron beam), and X-ray photoelectron spectroscopy (XPS, alternatively called ESCA; a method of irradiating grains with X-rays and spectroscopically analyzing photoelectrons emitted from the surface).

While not limiting, the outer layer covering the internal high silver iodide layer is preferably formed at a temperature of 30° to 80° C. still preferably 35° to 70° C. and a pAg of 6.5 to 11.5. Use of the aforesaid silver halide solvent sometimes brings about favorable results. The most preferred silver halide solvent is a thiocyanate.

Introduction of dislocation lines to the predominant plane of tabular grains can be achieved by depositing a silver halochloride on the predominant plane of basic grains, converting the deposited silver halochloride to a high silver bromide layer or a high silver iodide layer, and further providing a shell thereon. The silver halochloride includes silver chloride and silver chlorobromide or silver chloroiodobromide having a silver chloride content of 10 mol % or more, preferably 60 mol % or more. Deposition of the silver halochloride on the predominant plane of basic grains can be achieved by separate or simultaneous addition of an aqueous silver nitrate solution and an aqueous solution of an appropriate alkali metal salt (e.g., potassium chloride) or by addition of an emulsion comprising the silver halochloride, followed by ripening. Deposition of the silver halochloride is possible at any pAg but is preferably carried out at a pAg of 5.0 to 9.5. According to this method, tabular grains are allowed to grow preferentially to the thickness direction. The silver halochloride layer is deposited in an amount of 1 to 80 mol %, preferably 2 to 60 mol %, in terms of silver, based on the silver content of the basic grains. The deposited silver halochloride layer can be converted with an aqueous solution of a halide capable of forming a silver salt having lower solubility than the silver halochloride, thereby to introduce dislocation lines to the predominant plane of the tabular grains. For example, the silver halochloride layer is converted with a potassium iodide aqueous solution, and a shell is allowed to grow thereon to obtain final grains. The halogen conversion of the silver halochloride layer does not mean that all the silver halochloride is displaced with a silver salt of lower solubility. It is preferable that 5% or more, still preferably 10% or more, and particularly preferably 20% or more, of the silver halochloride layer is displaced with a silver salt of lower solubility. It is possible to introduce dislocation lines to local sites on the predominant plane by controlling the halogen structure of the basic grains on which a silver halochloride layer is to be deposited. For example, it is possible to introduce dislocation lines only to the peripheral portion, exclusive of the central portion, of the predominant plane by using basic tabular grains having an internal high silver iodide structure displaced to the lateral direction thereof. Further, dislocation lines can be introduced to only the central portion of the predominant plane by using basic tabular grains having an outer high silver iodide structure displaced to the lateral direction thereof. It is also possible to deposit a silver halochloride on only a limited area by using a substance controlling the site of epitaxial growth of a silver halochloride, e.g., an iodide, and to introduce dislocation lines only to that limited area. The temperature for deposition of a silver halochloride is preferably 30° to 70° C., still preferably 30° to 50° C. Halogen conversion after deposition of a silver halochloride may be conducted either before or simultaneously with shell growth.

The internal silver halochloride layer which is formed in substantial parallel with the predominant plane is preferably located within the site corresponding to a silver content of not less than 5 mol % and less than 100 mol %, still preferably not less than 20 mol % and less than 95 mol %, particularly preferably not less than 50 mol % and less than 90 mol %, based on the total silver content.

The shell preferably has a silver iodide content of 0 to 30 mol %, still preferably 0 to 20 mol %. While arbitrary, the shell is preferably formed at a temperature of 30° to 80° C., still preferably 35° to 70° C., and a pAg of 6.5 to 11.5. Use of the above-described silver halide solvent sometimes brings about favorable results. The most preferred silver halide solvent is a thiocyanate. The above-mentioned analysis on halogen composition of finally obtained silver halide grains sometimes fails to confirm the presence of the internal silver halochloride layer having undergone halogen conversion depending on the conditions, such as the degree of the halogen conversion, but permits clear observation of the introduced dislocation lines.

The above-described method for introducing dislocation lines to an arbitrary site on the predominant plane of tabular grains and the aforesaid method for introducing dislocation lines to an arbitrary site on the periphery of the tabular grains may be combined appropriately.

Silver halide emulsions which can be used in combination include silver bromide, silver iodobromide, silver iodochlorobromide, and silver chlorobromide. Silver iodobromide or silver iodochlorobromide containing not more than 30 mol % of silver iodide is preferred.

The tabular grains which can be used in the present invention can easily be prepared by known processes described, e.g., in Cleve, *Photography Theory and Practice*, p. 131 (1930), *Gutoff, Photographic Science and Engineering*, Vol. 14, pp. 248–257 (1970), U.S. Pat. Nos. 4,434,226, 4,414,310, 4,433,048, and 4,439,520, and British Patent 2,112,157.

The silver halide emulsions are usually subjected to chemical sensitization. Chemical sensitization can be carried out by known methods described, e.g., H. Frieser (ed.), *Die Grundlagen der Photographischen Prozesse mit Selberhalogeniden*, pp. 675–734, Akademische Verlagsgesellschaft (1968). Chemical sensitization includes sulfur sensitization using active gelatin or a sulfur-containing compound capable of reacting with silver (e.g., thiosulfates, thioureas, mercapto compounds, and rhodanines), reduction sensitization using a reducing substance (e.g., stannous salts, amines, hydrazine derivatives, formamidinesulfinic acid, and silane compounds), noble metal sensitization using a noble metal compound (e.g., complex salts of gold or the group VIII metal, e.g., Pt, Ir or Pd), selenium sensitization using a selenium compound (e.g., selenoureas, selenoketones, and selenides), and the like, and an appropriate combination thereof.

For the purpose of preventing fog during preparation, preservation or photographic processing of a light-sensitive material or for stabilizing the photographic performance properties, various compounds may be incorporated into the photographic emulsion. Such compounds include azoles, such as benzothiazolium salts, nitroindazoles, benzotriazoles, and benzimidazoles (especially nitro- or halogen-substituted compounds); heterocyclic mercapto compounds, such as mercaptothiazoles, mercaptobenzothiazoles, mercaptobenzimidazoles, mercaptothiadiazoles, mercaptotetrazoles (especially 1-phenyl-5-mercaptotetrazole), and mercaptopyrimidines; the above-mentioned heterocyclic mercapto compounds having a water-soluble group (e.g., carboxyl or sulfo); thioketo compounds, such as oxazolinethione; azaindenes, such as tetraazaindenes (especially 4-hydroxy-substituted (1,3,3a,7)-tetraazaindenes); benzenethiosulfonic acids; benzenesulfinic acids; and many other compounds known as antifoggants or stabilizers.

The antifoggant or stabilizer is usually added after completion of chemical sensitization, preferably during chemical ripening or at an appropriate stage before the start of chemical ripening (i.e., during grain growth); that is, during addition of a silver salt solution, after the addition and before the commencement of chemical ripening, or during the chemical ripening (preferably by the time when chemical ripening proceeds by 50%, particularly 20%).

The amount of the antifoggant or stabilizer to be added is subject to variation depending on the manner of addition and the amount of the silver halide but preferably ranges form $1\times10^{-7}$ to $1\times10^{-2}$ mol, still preferably from $1\times10^{-5}$ to $1\times10^{-2}$ mol, per mole of silver halide.

Gelatin is advantageously used as a binder or a protective colloid in photographic emulsions. Other hydrophilic colloids may also be used as well. Examples of usable hydrophilic colloids are proteins, such as gelatin derivatives, graft polymers of gelatin with other high polymers, albumin, and casein; cellulose derivatives, e.g., hydroxyethyl cellulose, carboxymethyl cellulose, and cellulose sulfate; sugar derivatives, e.g., sodium alginate and starch derivatives; and a variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. and copolymers comprising monomers constituting these homopolymers.

Gelatin species which can be used include lime-processed gelatin, acid-processed gelatin, enzyme-processed gelatin as described in *Bull. Soc. Sci. Phot. Japan*, No. 16, p. 30 (1966), and hydrolysis products or enzymatic decomposition products of gelatin. Gelatin derivatives which can be used include those obtained by reacting gelatin with various compounds, such as acid halides, acid anhydrides, isocyanates, bromoacetic acid, alkanesultones, vinylsulfonamides, maleinimide compounds, polyalkylene oxides, and epoxy compounds.

Dispersing media which can be used in the present invention are described in *Research Disclosure*, Vol. 176, No. 17643, Item IX (Dec., 1978).

The present invention is applicable to color light-sensitive materials for general use or for motion pictures, such as color negative films, color reversal films, color negative films for motion pictures, color positive films, and positive films for motion pictures; and black-and-white light-sensitive materials, such as black-and-white negative films, microfilms, and X-ray films.

Color light-sensitive materials, to which the present invention is applied, generally comprise a support having thereon at least one light-sensitive layer. A typical color light-sensitive material comprises a support having thereon at least one light-sensitive layer composed of a plurality of silver halide emulsion layers which have substantially the same color sensitivity (sensitive to blue light, green light or red light) but are different in sensitivity (hereinafter referred to as a light-sensitive layer unit). In a multilayer silver halide color photographic material, light-sensitive layer units are generally provided on a support in the order of a red-sensitive layer unit, a green-sensitive layer unit, and a blue-sensitive layer unit from the support side. Depending on the end use, the above order of layers may be reversed, or two layers having the same color sensitivity may have therebetween a layer having different color sensitivity. A light-insensitive layer may be provided as an intermediate layer between the above-described silver halide light-sensitive layers, a bottom layer or a top layer. These layers may contain couplers, DIR compounds, color mixture preventives, and the like.

A plurality of silver halide emulsion layers constituting each light-sensitive layer unit generally have a two-layer structure composed of a high-speed emulsion layer and a low-speed emulsion layer, which are preferably provided in an order of descending sensitivity toward the support, as described in West German Patent 1,121,470 and British Patent 923,045. It is also possible to provide a low-speed emulsion layer on the side farther from the support, and a high-speed emulsion later on the side closer to the support, as described in JP-A-57-112751, JP-A-62-200350, JP-A-62-206541, and JP-A-62-206543.

Examples of layer orders include an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, and an order of BH/BL/GH/GL/RL/RH, each from the side farthest from the support.

A layer order of blue-sensitive layer/GH/RH/GL/RL from the side farthest from the support as described in JP-B-55-34932 and a layer order of blue-sensitive layer/GL/RL/GH/RH from the side farthest from the support as described in JP-A-56-25738 and JP-A-62-63936 are also employable.

Further, a light-sensitive unit may be composed of three layers whose sensitivity varies in a descending order toward the support, i.e., the highest-speed emulsion layer as the upper layer, a middle-speed emulsion layer as an intermediate layer, and the lowest-speed emulsion layer as the lower layer, as proposed in JP-B-49-15495. Three layers of different sensitivity in each unit may also be arranged in the order of middle-speed emulsion layer/high-speed emulsion layer/low-speed emulsion layer from the side farther from a support as described in JP-A-59-202464.

Furthermore, an order of high-speed emulsion layer/low-speed emulsion layer/middle-speed emulsion layer or an order of low-speed emulsion layer/middle-speed emulsion layer/high-speed emulsion layer are also employable. In the case of multilayer structures composed of 4 or more layers, the order of layers may be altered similarly.

An interlayer effect-donating layer (CL) which has a different spectral sensitivity distribution from a main light-sensitive layer (BL, GL or RL) is preferably provided next or close to the main light-sensitive layer for the purpose of improving color reproducibility, as described in U.S. Pat. Nos. 4,663,271, 4,705,744 and 4,707,436, JP-A-62-160448, and JP-A-63-89850.

Silver halides which can be preferably used in the present invention are silver iodobromide, silver iodochloride and silver iodochlorobromide having a silver iodide content of not more than 30 mol %. Silver iodobromide or silver iodochlorobromide having a silver iodide content of about 2 mol % to about 10 mol % are still preferred.

The silver halide emulsion grains include so-called regular grains having a regular crystal form, such as a cubic form, an octahedral form or a tetradecahedral form; those having an irregular crystal form, such as a spherical form and a tabular form; those having a crystal defect such as a twinning plane, and those having a composite form of these crystal forms.

The silver halide grains may have a broad range of size, form about 0.2 μm or even smaller up to about 10 μm in terms of projected area diameter. The emulsion may be either a polydispersion or a monodispersion.

The silver halide emulsions to be used in the present invention can be prepared by known techniques described, e.g., in *Research Disclosure,* No. 17643, pp. 22–23, "I. Emulsion preparation and types" (December, 1978), ibid., No. 18716, p. 648 (November, 1979), ibid., No. 307105, pp. 863–865 (November, 1989), P. Glafkides, *Chemie et Phisique Photographique,* Paul Montel (1967), G. F. Duffin, *Photographic Emulsion Chemistry,* Focal Press (1966), and V. L. Zelikman, et al., *Making and Coating Photographic Emulsion,* Focal Press (1964).

The monodispersed emulsions described in U.S. Pat. Nos. 3,574,628 and 3,655,394 and British Patent 1,413,748 are preferably used.

Tabular grains having an aspect ratio of about 3 or more are also useful in the present invention. The tabular grains can easily be prepared by known processes described, e.g., in Gutoff, *Photographic Science and Engineering,* Vol. 14, pp. 248–257 (1970), U.S. Pat. Nos. 4,434,226, 4,414,310, 4,433,048, and 4,439,520, and British Patent 2,112,157.

The silver halide grains may have a homogeneous crystal structure, or may have a heterogeneous structure in which the inside and the outside have different halogen compositions, or may have a layered structure. Silver halides of different composition may be fused by epitaxy. Compounds other than silver halides, such as silver thiocyanate or lead oxide, may be fused to silver halide grains. Further, a mixture of various grains having different crystal forms may be used.

The emulsions may be any of a surface latent image type which forms a latent image predominantly on the surface of the grains, an internal latent image type which forms a latent image predominantly in the inside of the grains, and a type which forms a latent image both on the surface and in the inside. In any case, the emulsion must be of negative type. The internal latent image type emulsion may be a core/shell type emulsion as described in JP-A-63-264740. The process for preparing a core/shell type internal latent image type emulsion is described in JP-A-59-133542. The shell thickness is preferably 3 to 40 nm, still preferably 5 to 20 nm, while varying depending on development processing, etc.

The silver halide emulsions are usually used after being subjected to physical ripening, chemical ripening, and spectral sensitization. Additives used in these steps are described in *Research Disclosure,* Nos. 17643, 18716, and 307105 as hereinafter tabulated.

A mixture of two or more emulsions different in at least one characteristics of grain size, grain size distribution, halogen composition, grain shape, and sensitivity may be used in the same layer.

Surface fogged silver halide grains described in U.S. Pat. No. 4,082,553, internal fogged silver halide grains described in U.S. Pat. No. 4,626,498 and JP-A-59-214852, and colloidal silver are preferably applied to light-sensitive silver halide emulsion layers and/or substantially light-insensitive hydrophilic colloid layers. The terminology "surface or internal fogged silver halide grains" as used herein means silver halide grains which are developable uniformly (i.e., non-imagewise) irrespective of exposure. The method for preparing these fogged grains is described in U.S. Pat. Nos. 4,626,498 and JP-A-59-214852. In internal fogged core/shell type grains, the silver halide forming the core may have a different halogen composition. Internal or surface fogged silver halides may be any of silver chloride, silver chlorobromide, silver iodobromide, and silver chloroiodobromide. The fogged grains preferably have an average grain size of 0.01 to 0.75 μm, particularly 0.05 to 0.6 μm. The fogged grains may be regular crystals and may be either polydispersed or monodispersed but are preferably monodispersed (at least 95% by weight or number of the total grains have a grain size falling within ±40% of an average).

It is preferable to use light-insensitive fine silver halide grains in the present invention. The terminology "light-insensitive fine silver halide grains" as used herein means fine silver halide grains which are insensitive to imagewise exposure for color image formation and therefore undergo substantially no development in the subsequent development processing. It is preferable for the light-insensitive fine silver halide grains not to be fogged previously. The fine silver halide grains have a silver bromide content of from 0 up to 100 mol % and, if necessary, may contain silver chloride and/or silver iodide, preferably contain 0.5 to 10 mol % of silver iodide. The fine silver halide grains preferably have an average grain size (an average projected area circle-equivalent diameter) of 0.01 to 0.5 μm, still preferably 0.02 to 0.2 μm.

The fine silver halide grains can be prepared in the same manner as for general light-sensitive silver halide grains. The surface of the fine silver halide grains needs neither optical sensitization nor spectral sensitization. It is preferable to add known stabilizers, such as triazoles, azaindenes, benzothiazolium salts, mercapto compounds, and zinc compounds, to the fine silver halide grains prior to addition to a coating composition. Colloidal silver may be incorporated into the layer containing the fine silver halide grains.

The light-sensitive materials according to the present invention preferably have a silver coating weight of not more than 6.0 $g/m^2$, still preferably not more than 4.5 $g/m^2$.

Known photographic additives which can be used in the present invention are described in *Research Disclosure,* Nos. 17643, 18716, and 30710 as shown in the table below.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Brightening Agent | p. 24 | p. 647, RC | p. 868 |
| 5. Light Absorber, Filter Dye, Ultrasonic Absorber | pp. 25–26 | p. 649, RC to p. 650, left column (LC) | p. 873 |
| 6. Binder | p. 26 | p. 651, LC | pp. 873–874 |
| 7. Plasticizer, Lubricant | p. 27 | p. 650, RC | p. 876 |
| 8. Coating Aid, Surface Active Agent | pp. 26–27 | p. 650, RC | pp. 875–876 |
| 9. Antistatic Agent | p. 27 | " | pp. 876–877 |
| 10. Matting Agent | | | pp. 878–879 |

While various color forming couplers can be used in the light-sensitive materials of the present invention, the following couplers are particularly preferred.

Yellow Couplers:

Couplers represented by formulae (I) and (II) of EP 502,424A, couplers represented by formulae (1) and (2) of EP 513,496A (especially Y-28 on page 18), couplers represented by formula (I) claimed in claim 1 of JP-A-5-307248, couplers represented by formula (I) of U.S. Pat. No. 5,066,576, col. 1, pp. 45–55, couplers represented by formula (I) of JP-A-4-274425, couplers claimed in claim 1 (page 40) of EP 498,381A (especially D-35 on page 18), couplers represented by formula (Y) of EP 447,969A, page 4 (especially Y-1 on page 17 and Y-54 on page 41), and couplers represented by formulae (II) to (IV) of U.S. Pat. No. 4,476,219, col. 7, pp. 36–58 (especially II-17 and 19 in col. 17 and II-24 in col. 19).

Magenta Coupler:

Couplers of JP-A-3-39737 (L-57 in the lower right part of page 11, L-68 in the lower right part of page 12, and L-77 in the lower right part of page 13; couplers of EP 456,257 ([A-4]-63 on page 134 and [A-4]-73 and -75 on page 139); couplers of EP 486,965 (M-4 and -6 on page 26 and M-7 on page 27); couplers of JP-A-6-43611 (M-45); couplers of JP-A-5-204106 (M-1); and couplers of JP-A-4-362631 (M-22).

Cyan Coupler:

Couplers of JP-A-4-204843 (CX-1, 3, 4, 5, 11, 12, 14, and 15 on pp. 14–16; couplers of JP-A-4-43345 (C-7 and 10 on p. 35, C-34 and 35 on p. 37, and (I-1) and (I-17) on pp. 42–43); and couplers represented by formulae (Ia) or (Ib) claimed in claim 1 of JP-A-6-67385.

Polymer Coupler:

P-1 and P-5 (p. 11) of JP-A-2-44345.

Examples of suitable couplers which develop a dye having moderate diffusibility are described in U.S. Pat. No. 4,366,237, British Patent 2,125,570, EP 96,873B, and West German Patent (OLS) No. 3,234,533.

Examples of suitable colored couplers which can be used for correcting unnecessary absorption of a developed dye are yellow-colored cyan couplers represented by formulae (CI), (CII), (CIII), and (CIV) described in EP 456,257A1, page 5 (especially YC-86 on page 84), yellow-colored magenta couplers ExM-7 (page 202), EX-1 (page 249), and EX-7 (page 251) of EP 456,257A1, coupler (2) of U.S. Pat. No. 3,833,069, column 8, and colorless masking couplers represented by formula (A) claimed in claim 1 of WO 92/11575 (especially the compounds on pp. 36–45).

Compounds (inclusive of couplers) capable of releasing a photographically useful residue on reacting with an oxidized developing agent include development inhibitor-releasing compounds, such as the compounds represented by formulae (I) to (IV) on page 11 of EP 378,236A1 (especially T-101 on p. 30, T-104 on p. 31, T-113 on p. 36, T-131 on p. 45, T-144 on p. 51, and T-158 on p. 58), the compounds represented by formula (I) on page 7 of EP 436,938A2 (especially D-49 on p. 51), the compounds represented by formula (1) of JP-A-5-307248 (especially (23)), and the compounds represented by formulae (I) to (III) on pages 5 to 6 of EP 440,195A2 (especially I-(1) on p. 29); bleaching accelerator-releasing compounds, such as the compounds represented by formulae (I) and (I') on page 5 of EP 310,125A2 (especially (60) and (61) on p. 61) and the compounds represented by formula (I) claimed in claim 1 of JP-A-6-59411 (especially (7)); ligand-releasing compounds, such as the compounds represented by formula LIG-X claimed in claim 1 of U.S. Pat. No. 4,555,478 (especially the compounds in col. 12, pp. 21–41); leuco dye-releasing compounds, such as compounds 1 to 6 in cols. 3 to 8 of U.S. Pat. No. 4,749,641; fluorescent dye-releasing compounds, such as the compounds represented by formula COUP-DYE claimed in claim 1 of U.S. Pat. No. 4,774,181 (especially compounds 1 to 11 in cols. 7 to 10); development accelerator- or fogging agent-releasing compounds, such as the compounds represented by formulae (1) to (3) in col. 3 of U.S. Pat. No. 4,656,123 (especially (I-22) in col. 25), and ExZK-2 on p. 75, 11. 36 to 38 of EP 450,637A2; and compounds releasing a group which becomes a dye on release, such as the compounds represented by formula (I) claimed in claim 1 of U.S. Pat. No. 4,857,447 (especially Y-1 to Y-19 in cols. 25–36).

Additives other than couplers which can preferably be used in the present invention are as follows. Dispersing media for oil-soluble organic compounds include P-3, 5, 16, 19, 25, 30, 42, 49, 54, 55, 66, 81, 85, 86, and 93 of JP-A-62-215272 (pp. 140–144). Impregnating lateces of oil-soluble organic compounds include those described in U.S. Pat. No. 4,199,363. Scavengers for an oxidized developing agent include the compounds represented by formula (I) of U.S. Pat. No. 4,978,606, col. 2, 11. 54–62 (especially I-(1), (2), (6) and (12) in cols. 4–5) and the compounds in col. 2, 11. 5–10 of U.S. Pat. No. 4,923,787 (especially compound 1 in col. 3). Stain inhibitors include the compounds of formulae (I) to (III) on p. 4, 11. 30–33 of EP 298321A (especially 1–47 and 72 and III-1 and 27 on pp. 24–48). Discoloration preventives include A-6, 7, 20 to 26, 30, 37, 40, 42, 48, 63, 90, 92, 94, and 164 on pp. 69–118;

II-1 to III-23 in cols. 25–38 of U.S. Pat. No. 5,122,444 (especially III-10); I-1 to III-4 on pp. 8–12 of EP 471347A (especially II-2); and A-1 to 48 in cols. 32–40 of U.S. Pat. No. 5,139,931 (especially A-39 and 42). Color formation enhancing agents or materials for reducing the amount of color mixing preventives include I-1 to II-15 on pp. 5–24 of EP 411324A (especially 1–46). Formalin Scavengers include SCV-1 to 28 on pp. 24–29 of EP 477932A (especially SCV-8). Hardening agents include H-1, 4, 6, 8 and 14 on p. 17 of JP-A-1-214845, the compounds represented by formulae (VII) to (XII) in cols. 13–23 of U.S. Pat. No. 4,618,573 (H-1 to 54), the compounds represented by formula (6) in the right lower part on page 8 of JP-A-2-214852 (H-1 to 76, especially H-14), and the compounds claimed in claim 1 of U.S. Pat. No. 3,325,287. Development inhibitor precursors include P-24, 37 and 39 on pp. 6–7 of JP-A-62-168139, and the compounds claimed in claim 1 of U.S. Pat. No. 5,019,492 (especially 28 and 29 in col. 7). Antiseptics and antifungal agents include I-1 to III-43 in cols. 3–15 of U.S. Pat. No. 4,923,790 (especially II-1, 9, 10 and 18 and III-25). Stabilizers and antifoggants include I-1 to (14) in cols. 6–16 of U.S. Pat. No. 4,923,793 (especially I-1, 60, (2) and (13)), and compounds 1 to 65, especially 36, in cols. 25–32 of U.S. Pat. No. 4,952,483. Chemical sensitizers include triphenylphosphine, selenides, and compound 50 of JP-A-5-40324. Dyes include a-1 to b-20 (especially a-1, 12, 18, 27, 35 and 36 and b-5) on pp. 15–18 of JP-A-3-156450 and V-1 to 23 (especially V-1) on pp. 27–29, ibid., F-1-1 to F-II-43 (especially F-1-11 and F-II-8) on pp. 33–55 of EP 445627A, III-1 to 36 (especially III-1 and 3) on pp. 17–28 of EP 457153A, microcrystalline dispersions of Dye-1 to 124 on pp. 8–26 of WO 88/04794, compounds 1 to 22 on pp. 6–11 of EP 319999A (especially compound 1), compounds D-1 to 87 (pp. 3–28) represented by formulae (1) to (3) of EP 519306A, compounds 1 to 22 (cols. 3–10) represented by formula (I) of U.S. Pat. No. 4,268,622, and compounds (1) to (31) (cols. 2 to 9) represented by formula (I) of U.S. Pat. No. 4,923,788. Ultraviolet absorbers include compounds (18b) to (18r) and 101 to 427 (pp. 6–9) represented by formula (1) of JP-A-46-3335, compounds (3) to (66) (pp. 10–44) represented by formula (I) and compounds HBT-1 to 10 (p. 14) represented by formula (III) of EP 520938A, and compounds (1) to (31) (cols. 2–9) represented by formula (1) of EP 521823A.

The present invention can be applied to a variety of color light-sensitive materials, such as color negative films for general use or for motion pictures, color reversal films for slides or TV, color paper, color positive films, and color reversal paper. The present invention is also suited to film units with a lens described in JP-B-2-32615 and JP-A-U-3-39784 (the term "JP-A-U" as used herein means an "unexamined published Japanese utility model application").

Examples of supports which can be suitably used in the light-sensitive materials of the present invention are described, e.g., in *Research Disclosure,* No. 17632, p. 28, ibid., No. 18716, p. 647, right column to p. 648, left column, and ibid., No. 307105, p. 879.

In the light-sensitive materials of the present invention, the hydrophilic colloidal layers on the side having emulsion layers preferably have a total film thickness of not more than 28 μm, more preferably not more than 23 μm, still preferably not more than 18 μm, particularly preferably not more than 16 μm, and a rate of swelling $T_{1/2}$ of not more than 30 seconds, still preferably not more than 20 seconds. The terminology "total film thickness" as used herein means a film thickness as measured after conditioning at 25° C. and a relative humidity of 55% for 2 days. The terminology "rate of swelling $T_{1/2}$" means a time required for a light-sensitive material to be swollen to ½ the saturated swollen thickness, the saturated swollen thickness being defined to be 90% of the maximum swollen thickness which is reached when the light-sensitive material is swollen with a color developing solution at 30° C. for 3 minutes and 15 seconds. The rate of swelling can be measured with a swellometer of the type described in A. Green, et al., *Photographic Science and Engineering,* Vol. 19, No. 2, pp. 124–129.

$T_{1/2}$ can be controlled by adding a proper amount of a hardening agent for a gelatin binder or by varying aging conditions after coating.

Further, the light-sensitive material preferably has a degree of swelling of from 150 to 400%. The terminology "degree of swelling" as used herein means a value obtained from the maximum swollen film thickness as defined above according to formula: (maximum swollen film thickness—film thickness)/film thickness.

The light-sensitive material of the present invention preferably has a hydrophilic colloidal layer(s) called a backing layer having a total dry thickness of from 2 to 20 μm on the side opposite to the emulsion layer side. The backing layer preferably contains the above-described additives, e.g., light absorbents, filter dyes, ultraviolet absorbents, antistatic agents, hardening agents, binders, plasticizers, lubricants, coating aids, and surface active agents. The backing layer preferably has a degree of swelling of from 150 to 500%.

The photographic materials can be development processed in a conventional manner as described in *Research Disclosure,* No. 17643, pp. 28–29, ibid., No. 18716, p. 615, left to right columns, and ibid., No. 307105, pp. 880–881.

A color developing solution to be used for color development processing is preferably an aqueous alkali solution containing an aromatic primary amine color developing agent as a main component. Useful color developing agents include aminophenol compounds and preferably p-phenylenediamine compounds. Typical examples and preferred examples of p-phenylenediamine compounds include the compounds described on pages 43 to 52 of EP 556700A. These developing agents may be used either individually or as a combination of two or more thereof according to the purpose.

The color developing solution generally contains pH buffering agents, such as carbonates, borates or phosphates of alkali metals, and development inhibitors or antifoggants, such as chlorides, bromides, iodides, benzimidazoles, benzothiazoles, and mercapto compounds. If desired, the color developing solution further contains various preservatives, such as hydroxylamine, diethylhydroxylamine, sulfites, hydrazines (e.g., N,N-biscarboxymethylhydrazine), phenyl semicarbazides, triethanolamine, and catecholsulfonic acids; organic solvents, such as ethylene glycol and diethylene glycol; development accelerators, such as benzyl alcohol, polyethylene glycol, quaternary ammonium salts, and amines; dye-forming couplers; competing couplers; auxiliary developing agents (e.g., 1-phenyl-3-pyrazolidone); viscosity-imparting agents; and various chelating agents, such as aminopolycarboxylic acids, aminopolyphosphonic acids, alkylphosphonic acids, and phosphonocarboxylic acids (e.g., ethylenediaminetetraacetic acid, nitrilotriacetic acid, ethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts thereof).

In case of carrying out reversal processing, color development is generally preceded by black-and-white (hereinafter abbreviated as B/W) development. A B/W developing solution to be used for B/W development contains one or more of known B/W developing agents, such as dihydroxybenzenes (e.g., hydroquinone), 3-pyrazolidones (e.g., 1-phenyl-3-pyrazolidone), and aminophenols (e.g., N-methyl-p-aminophenol).

The color or B/W developing solution generally has a pH between 9 and 12. A rate of replenishment for these developing solutions, though varying depending on the kind of the photographic material to be processed, is usually not more than 3 l per $m^2$ of a light-sensitive material. The rate of replenishment can be reduced to 500 $ml/m^2$ or less by reducing a bromide ion concentration in the replenisher. When processing is carried out at a reduced rate of replenishment, it is desirable to prevent evaporation and aerial oxidation of the processing solution by minimizing a contact area of the processing solution with air.

The contact area between a photographic processing solution and air can be expressed in terms of opening ratio calculated by dividing a contact area ($cm^2$) of the processing solution with air by a volume ($cm^3$) of the processing solution. The opening ratio as defined above is preferably not more than 0.1, still preferably from 0.001 to 0.05.

The opening ratio of the processing tank can be adjusted by, for example, putting a barrier, such as a floating Lid, on the liquid surface, using a movable lid as described in JP-A-1-82033, or utilizing slit development processing as described in JP-A-63-216050. Reduction of the opening ratio is desirable in not only color development and B/W development but also all the subsequent steps, such as bleach, blix, fixing, washing, and stabilization. The rate of replenishment may also be reduced by using a means for suppressing accumulation of bromide ions in the developing solution.

A processing time with the color developing solution is from 2 to 5 minutes. The processing time may be shortened by conducting development processing at an elevated temperature and an increased pH at an increased concentration of the color developing agent.

The photographic emulsion layers after color development are usually subjected to bleaching. Bleaching and fixing may be carried out either simultaneously (blix) or separately. For rapid processing, bleaching may be followed by blix. Further, the mode of desilvering can be arbitrarily selected according to the end use. For example, blix may be effected using two tanks connected, or fixing may be followed by blix, or blix may be followed by bleaching.

Bleaching agents to be used include compounds of polyvalent metals, e.g., iron (III), peracids, quinones, and nitroso compounds. Typical bleaching agents include organic complex salts of iron (III), e.g., complex salts with aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanoltetraacetic acid, glycol ether diaminetetraacetic acid), citric acid, tartaric acid, or malic acid. From the standpoint of suitability to rapid processing and prevention of environmental pollution aminopolycarboxylic acid iron (III) complexes, such as (ethylenediaminetetraacetato) iron (III) salts and (1,3-diaminopropanetetraacetato)iron (III) salts, are preferred. Aminopolycarboxylic acid iron (III) complex salts are particularly useful either in a bleaching bath or in a blix bath. A bleaching bath or blix bath containing these aminopolycarboxylic acid iron (III) complex salts usually has a pH of 4.0 to 8.0. A lower pH may be used for rapid processing.

If desired, a fixing bath, a blix bath, or a prebath thereof may contain bleach accelerators. Useful bleach accelerators include compounds having a mercapto group or a disulfide group as described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July, 1978); thiazolidine derivatives as described in JP-A-50-140129; thiourea derivatives as described in JP-B-45-8506, JP-A-52-20832, JP-A-53-32735, and U.S. Pat. No. 3,706,561; iodides as described in German Patent 1,127,715 and JP-A-58-16235; polyoxyethylene compounds as described in German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and bromide ions. Among them, compounds having a mercapto group or a disulfide group are preferred for their high accelerating effect. The compounds disclosed in U.S. Pat. No. 3,893,858, German Patent 1,290,812, and JP-A-53-95630 are particularly preferred. In addition, the compounds disclosed in U.S. Pat. No. 4,552,834 are also preferred. These bleach accelerators may be incorporated into a light-sensitive material. The bleach accelerators are particularly effective for blix of color light-sensitive materials for photographing.

For the purpose of preventing bleaching stain, the bleaching or blix bath preferably contains organic acids. Particularly preferred organic acids used to this effect are those having an acid dissociation constant (pKa) of from 2 to 5, e.g., acetic acid, propionic acid, and hydroxyacetic acid.

Fixing agents which can be used in a fixing or blix bath include thiosulfates, thiocyanates, thioether compounds, thioureas, and a large quantity of an iodide, with thiosulfates being commonly employed. In particular, ammonium thiosulfate is widely useful. A combined use of a thiosulfate and a thiocyanate, a thioether compound, a thiourea, etc. is also preferred. Preservatives for the fixing or blix bath preferably include sulfites, bisulfites, carbonyl-bisulfite adducts, and sulfinic acid compounds described in EP 294769A.

The fixing or blix bath preferably contains various aminopolycarboxylic acids or organophosphonic acids for stabilization.

Further, the fixing or blix bath preferably contains 0.1 to 10 mol/l of compounds having a pKa of from 6.0 to 9.0 for pH adjustment, preferably imidazoles, e.g., imidazole, 1-methylimidazole, 1-ethylimidazole, and 2-methylimidazole.

The total time of desilvering is preferably as short as possible as long as desilvering inadequacy does not result. A preferred desilvering time is from 1 to 3 minutes, still preferably from 1 to 2 minutes. The desilvering temperature is from 25° to 50° C., and preferably from 35° to 45° C. In the preferred temperature range, the rate of desilvering is improved, and stain formation after processing is effectively prevented.

During desilvering, it is desirable to enhance agitation as much as possible. Methods or means for enhancing agitation include a method in which a jet stream of a processing solution is made to strike against the surface of the emulsion layer as described in JP-A-62-183460; a method of using a rotating means to increase the stirring effects as described in JP-A-62-183461; a method in which a light-sensitive material is moved with its emulsion surface being in contact with a wiper blade placed in a processing solution to make turbulence; and a method of increasing a total flow of a circulating processing solution. These means for enhanced agitation are effective in any of a bleaching bath, a blix bath and a fixing bath. Enhanced agitation appears to accelerate supply of a bleaching agent or a fixing agent to emulsion layers and, as a result, to increase the rate of desilvering.

The above-described means for enhanced agitation is more effective when combined with a bleach accelerator, markedly increasing the acceleration effects and eliminating the fixing inhibitory effect of the bleach accelerator.

An automatic developing machine which can be used for processing the light-sensitive material preferably has a means for carrying a light-sensitive material as described in JP-A-60-191257, JP-A-60-191258, and JP-A-60-191259. As mentioned in JP-A-60-191257, such a carrying means is highly effective to considerably reduce a solution carryover from a previous bath to a next bath thereby to prevent deterioration of processing solution, and is particularly effective for reduction of processing time or replenishment rate in each processing step.

The light-sensitive material after desilvering is generally subjected to washing and/or stabilization.

The amount of washing water to be used in the washing step is selected from a broad range depending on characteristics of the light-sensitive material (e.g., the kind of photographic materials such as couplers), the end use of the light-sensitive material, the temperature of washing water, the number of washing tanks (the number of stages), the replenishing system (e.g., counter-flow system or direct-flow system), and other various conditions. For example, a relation between the number of washing tanks and the quantity of water in a multi-stage counter-flow system can be obtained by the method described in *Journal of the Society of Motion Picture and Television Engineers,* Vol. 64, pp. 248–253 (May, 1955).

According to the disclosed multi-stage counter-flow system, a requisite amount of water can be greatly reduced. On the other hand, bacteria tend to grow in the tank with an increase in water retention time, and suspended bacterial cells adhere to light-sensitive materials. Such a problem can be effectively coped with by adopting a method of reducing calcium and magnesium ions of washing water as described in JP-A-62-288838. It is also effective to use bactericides, such as isothiazolone compounds or thiabendazole compounds as described in JP-A-57-8542; chlorine type bactericides, e.g., chlorinated sodium isocyanurate; benzotriazole compounds; and other bactericides described in Horiguchi Hiroshi, *Bokin bobaizai no kagaku,* Sankyo Shuppan (1986), Eisei Gijutsukai (ed.), *Biseibutsu no mekkin, sakkin, bobai qijutsu* Kogyo Gijutsukai (1982), and Nippon Bokin Bobai Gakkai (ed.), *Bokin bobaizai jiten* (1986).

Washing water has a pH usually of 4 to 9, preferably 5 to 8. Washing conditions, though varying depending on the characteristics or the end use of the light-sensitive material and the like, are usually from 15° to 45° C. in temperature and from 20 seconds to 10 minutes in time, and preferably from 25° to 40° C. in temperature and from 30 seconds to 5 minutes in time.

The above-described washing may be followed by or replaced with stabilization. Where stabilization is conducted in place of washing, any of known stabilizing techniques described, e.g., in JP-A-57-8543, JP-A-58-14834, and JP-A-60-220345 can be utilized.

Where washing is followed by stabilization, a stabilizing bath to be used includes a solution containing a dye stabilizer and a surface active agent, which is used as a final bath for color light-sensitive materials for photographing. Suitable dye stabilizers include aldehydes, e.g., formalin and glutaraldehyde, N-methylol compounds, hexamethylenetetramine, and an aldehyde-sulfite adduct. If desired, the stabilizing bath may also contain various chelating agents and antifungal agents.

An overflow accompanying replenishment for washing and/or stabilization may be reused in other processing steps, such as a desilvering step.

In cases where each processing solution is concentrated through vaporization during processing with an automatic developing machine, water is preferably supplied to the processing solution for correction of concentration.

For the purpose of simplifying and speeding up processing, the light-sensitive material may contain therein a color developing agent, preferably in the form of a precursor thereof. Examples of color developing agent precursors include indoaniline compounds described in U.S. Pat. No. 3,342,597, Schiff base compounds described in U.S. Pat. No. 3,342,599 and *Research Disclosure,* Nos. 14850 and 15159, aldol compounds described in *Research Disclosure,* No. 13924, metal complex salts described in U.S. Pat. No. 3,719,492, and urethane compounds described in JP-A-53-135628.

If desired, the light-sensitive material may further contain therein various 1-phenyl-3-pyrazolidone compounds for the purpose of accelerating color development. Typical examples of these accelerators are described in JP-A-56-64339, JP-A-57-144547, and JP-A-58-115438.

Each of the above-described processing solutions is used at a temperature of from 10° to 50° C. and, in a standard manner, from 33° to 38° C. Higher processing temperatures may be employed for reducing processing time, or lower temperatures may be employed for improving image quality or stability of the processing solution.

Various additives, processing methods and the like which can be used for the B/W light-sensitive material of the present invention are not particularly limited. For example, the following publications can be referred to.

1) Silver halide emulsions and preparation thereof:
   JP-A-2-68539, p. 8, right lower column (RL), 1. 6 from the bottom to p. 10, right upper column (RU), 1. 12.
2) Chemical sensitization:
   JP-A-2-68539, p. 10, RU, 1. 13 to left lower column (LL), 1.16; selenium sensitization described in JP-A-5-11389.
3) Antifoggants and stabilizers:
   JP-A-2-68539, p. 10, LL, 1. 17 to p. 11, LU, 1. 7, ibid., p. 3, LL, 1.2 to p. 4, LL.
4) Spectral sensitizing dyes:
   JP-A-2-68539, p. 4, RL, 1. 4 to p. 8, RL; JP-A-2-58041, p. 12, LL, 1. 8 to RL, 1. 19.
5) Surface active agents and antistatic agents:
   JP-A-2-68539, p. 11, LU, 1. 14 to p. 12, LU, 1. 9; JP-A-2-58041, p. 2, LL, 1. 14 to p. 5, 1. 12.
6) Matting agents, slip agents, and plasticizers:
   JP-A-2-68539, p. 12, LU, 1. 10 to RU, 1. 10; JP-A-2-58041, p. 5, LL, 1. 13 to p. 10, LL, 1. 3.
7) Hydrophilic colloid:
   JP-A-2-68539, p. 12, RU, 1. 11 to LL, 1. 16
8) Hardening agents:
   JP-A-2-68539, p. 12, LL, 1. 17 to p. 13, RU, 1. 6
9) Development processing:
   JP-A-2-68539, p. 15, LU, 1. 14 to LL, 1. 13.

The present invention are also applicable to heat developable light-sensitive materials described, e.g., in U.S. Pat. No. 4,500,626, JP-A-60-133449, JP-A-59-218443, JP-A-61-238056, and EP 210,660A.

The present invention will now be illustrated in greater detail with reference to Examples, but it should be understood that the present invention is not deemed to be limited thereto.

SYNTHESIS EXAMPLE 1

Synthesis of Compound (1)

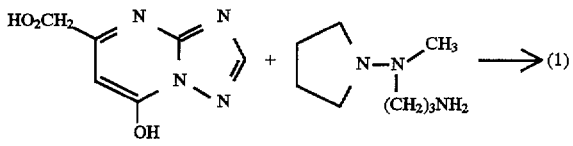

(A) (B)

To a mixture of 3.4 g (0.017 mol) of compound (A), 3 g (0.019 mol) of compound (B), and 25 ml of dimethylformamide was added 3.6 g (0.017 mol) of dicyclohexylcarbodiimide, and the mixture was heated at an external temperature of 45° C. for 3 hours while stirring. After allowing the mixture to stand overnight, precipitated crystals were removed by filtration. The filtrate was distilled under reduced pressure to remove the solvent. The oily residue of low viscosity was dissolved in ethanol, and ethyl acetate was added thereto to crystallize. Crystallization from ethyl acetate was repeated five times, and the resulting colorless crystals were collected by filtration by suction and dried to give 1.74 g of compound (1) in a yield of 30%. Melting point: 95°–97° C.

SYNTHESIS EXAMPLE 2

Synthesis of Compound (19)

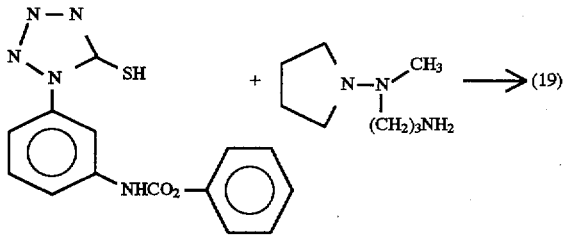

(C) (B)

To a mixture of 5 g (0.018 mol) of compound (C), 2.9 g (0.035 mol) of 2-methylimidazole, and 50 ml of acetonitrile was added 2.8 g (0.018 mol) of compound (B), and the mixture was heated under reflux in a nitrogen stream for 30 minutes. After cooling with water, precipitated crystals were collected by filtration by suction and washed by boiling in 100 ml of methanol for 30 minutes. After allowing to cool, the mixture was filtered by suction to give 4 g of colorless crystals in a yield of 60%. Melting point: 196°–198° C.

SYNTHESIS EXAMPLE 3

Synthesis of Compound (20)

Compound (20) (melting point: 171°–173° C.) was obtained in the same manner as in Synthesis Example 2, except for replacing compound (B) with an equimolar amount of compound (D) shown below.

Compound (D):

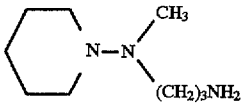

EXAMPLE 1

Example 1 is to demonstrate noticeable effects observed with silver halide light-sensitive materials containing a reduction sensitized silver halide emulsion which contains a hydrazine compound of formula (I).

Preparation of Seed Emulsion

An aqueous solution (1500 ml) containing 0.75 g of gelatin was kept at 35° C. while stirring. A silver potential was adjusted to −10 V with respect to a saturated calomel electrode, and a pH was adjusted to 1.90. An aqueous solution containing 0.85 g of silver nitrate and an aqueous solution containing 0.59 g of potassium bromide were added to the gelatin solution over 15 seconds in accordance with a double jet process. After elevating the temperature to 60° C., 8.3 g of gelatin was added thereto. The pH was adjusted to 5.5, and the silver potential was adjusted to −20 mV with respect to a saturated calomel electrode. An aqueous solution containing 227.1 g of silver nitrate and an aqueous solution of potassium bromide were added thereto over 45 minutes at increasing flow rates in accordance with a double jet process. During the addition, the silver potential was maintained at −20 mV with respect to a saturated calomel electrode. After desalting, 50 g of gelatin was added, the pH adjusted to 5.8, and the pAg adjusted to 8.8 to prepare a seed emulsion. The resulting seed emulsion contained 1 mole of Ag and 80 g of gelatin per kg. The emulsion grains were tabular grains having an average circle-equivalent diameter of 0.71 μm, a coefficient of size (circle-equivalent diameter) variation of 17%, an average thickness of 0.081 μm, and an average aspect ratio of 8.8.

Preparation of Emulsion Y (non-reduction-sensitized)

An aqueous solution (1200 ml) containing 134 g of the above-prepared seed emulsion, 1.9 g of potassium bromide, and 38 g of gelatin was kept at 65° C. with stirring. To the solution was added 4 mg of sodium benzenethiosulfonate, and an aqueous solution of 87.7 g of silver nitrate and a potassium bromide aqueous solution containing 9.0 wt % of potassium iodide were added thereto at increasing flow rates over 46 minutes according to a double jet process. During the addition, the silver potential was maintained at −20 mV with respect to a saturated calomel electrode. Thereafter, an aqueous solution of 42.6 g of silver nitrate and an aqueous potassium bromide solution were added over 17 minutes according to a double jet process. During the addition, the silver potential was kept at +40 mV with respect to a saturated calomel electrode. An aqueous potassium bromide solution was added to adjust the silver potential to −80 mV.

A silver iodide fine grain emulsion having an average circle-equivalent diameter of 0.025 μm and a coefficient of size (circle-equivalent diameter) distribution of 18% was abruptly added to the emulsion within 5 seconds in an amount of 8.5 g on silver nitrate conversion. Thirty seconds later, an aqueous solution of 66.4 g of silver nitrate was added at a decreasing flow rate over 4 minutes. The silver potential after the addition was −10 mV. The emulsion was washed with water in a conventional manner, gelatin added, the pH adjusted to 5.8, and the pAg adjusted to 8.8.

Preparation of Emulsion Z (reduction sensitized)

Emulsion Z was prepared in the same manner as for emulsion Y, except that 4 mg of sodium benzenethiosulfonate was replaced with 2 mg of thiourea dioxide and that 43 mg of sodium ethylthiosulfonate was added immediately before adjusting the silver potential to −80 mV with an aqueous potassium bromide solution.

The emulsion grains of both emulsions Y and Z were tabular grains having an average circle-equivalent diameter of 1.40 μm, a coefficient of size distribution of 19%, an average thickness of 0.159 μm, an average aspect ratio of 8.8, and an average sphere-equivalent diameter of 0.78 μm.

The proportion of emulsion grains having an aspect ratio of 8 or more in total grains was 60% or more in terms of projected area.

Observation of both the emulsions Y and Z under a transmission electron microscope (200 kV) at the temperature of liquid nitrogen revealed existence of dislocation lines at high density on the fringe of the tabular grains.

Each of emulsions Y and Z was heated to 60° C., and potassium hexachloroiridate, sensitizing dyes D-1, D-2, and D-3 shown below, potassium thiocyanate, chloroauric acid, sodium thiosulfate, and N,N-dimethylselenourea were added thereto to conduct optimum chemical sensitization.

Sensitizing Dye D-1:

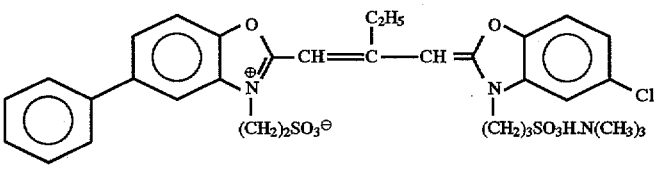

Sensitizing Dye D-2:

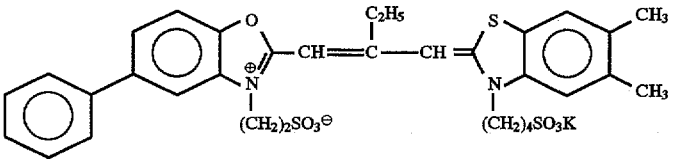

Sensitizing Dye D-3:

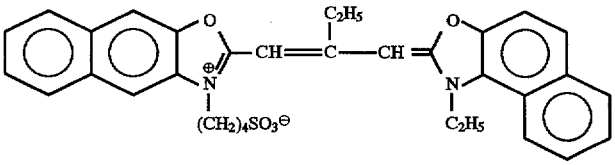

Upon completion of the chemical sensitization, compound (19), (21) or (23) of the present invention was added to the emulsion in an amount of $5\times10^{-4}$ mol per mole of silver halide.

Preparation of Coated Sample

A cellulose triacetate film support having a subbing layer was coated with a coating composition shown below and a protective layer having the following composition to prepare samples 301 to 308.

(1) Emulsion Layer Coating Composition:

| | |
|---|---|
| Emulsion (see Table 1 below) | $2.1\times10^{-2}$ mol-Ag/m$^2$ |
| Coupler | $1.5\times10^{3}$ mol/m$^2$ |

-continued

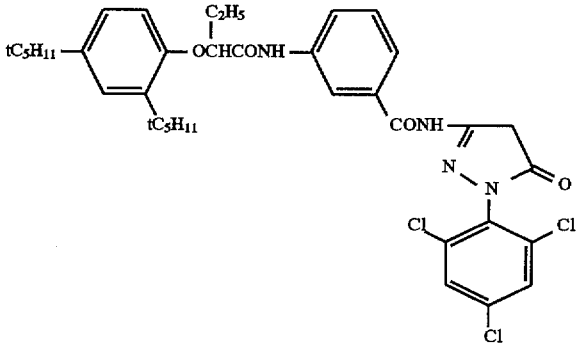

| | |
|---|---|
| Tricresyl phosphate | 1.10 g/m$^2$ |
| Gelatin | 2.30 g/m$^2$ |
| (2) Protective Layer Composition: | |
| 2,4-Dichloro-6-hydroxy-s-triazine Na salt | 0.08 g/m$^2$ |
| Gelatin | 1.80 g/m$^2$ |

The samples were allowed to stand at 40° C. and 70% RH for 14 hours and then exposed to light for 1/100 second through a gelatin filter SC-50 produced by Fuji Photo Film Co., Ltd. and a continuous wedge.

The exposed sample was processed with a Nega Processor FP-350 manufactured by Fuji Photo Film Co., Ltd. according to the following schedule until the cumulative amount of the replenisher for a processing solution reached 3 times the tank volume.

Processing Schedule:

| Step | Time | Temp. (°C.) | Rate of Replenishment (ml/unit area*) |
|---|---|---|---|
| Color development | 3'15" | 38 | 45 |
| Bleaching | 1'00" | 38 | 20 |
| | | | All the overflow of the bleaching bath entered the blix tank. |
| Blix | 3'15" | 38 | 30 |
| Washing (1) | 40" | 35 | counter-flow system from (2) to (1) |
| Washing (2) | 1'00" | 35 | 30 |
| Stabilization | 40" | 38 | 20 |
| Drying | 1'15" | 55 | |

Note: *Per 35 mm (W) × 1.1 m (L), which corresponds to a 24-exposure roll of film.
The composition of the processing solutions is shown below.

| | Tank Solution (g) | Replenisher (g) |
|---|---|---|
| Color Developer: | | |
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| hydroxylamine sulfate | 2.4 | 2.8 |
| 4-[N-Ethyl-N-(β-hydroxyethyl)amino]-2-methylaniline sulfate | 4.5 | 5.5 |
| Water to make | 1.0 l | 1.0 l |
| pH (adjusted with potassium hydroxide and sulfuric acid) | 10.05 | 10.10 |

-continued

| | | |
|---|---|---|
| Bleaching Bath: | | |
| The tank solution and replenisher had the same composition. | | |
| Ammonium (ethylenediaminetetraacetato)-iron (III) dihydrate | | 120.0 g |
| Disodium ethylenediaminetetraaacetate | | 10.0 g |
| Ammonium bromide | | 100.0 g |
| Ammonium nitrate | | 10.0 g |
| Bleach accelerator: $(CH_3)2N—CH_2—CH_2—S—S—CH_2—CH_2—N(CH_3)_2.2HCl$ | | 0.005 mol |
| Aqueous ammonia (27%) | | 15.0 ml |
| Water to make | | 1.0 l |
| pH (adjusted with aqueous ammonia and nitric acid) | | 6.3 |
| Blix Bath: | | |
| Ammonium (ethylenediaminetetra-acetato)iron (III) dihydrate | 50.0 | 0 |
| Disodium ethylenediaminetetraacetate | 5.0 | 2.0 |
| Sodium sulfite | 12.0 | 20.0 |
| Ammonium thiosulfate aqueous solution (700 g/l) | 240.0 ml | 400.0 ml |
| Aqueous ammonia (27%) | 6.0 ml | — |
| Water to make | 1.0 l | 1.0 l |
| pH (adjusted with aqueous ammonia and acetic acid) | 7.2 | 7.3 |

Washing Water

The tank solution and replenisher had the same composition.

Tap water was passed through a mixed bed column packed with an H type strongly acidic cation exchange resin (Amberlite IR-120B, produced by Rohm & Haas Co.) and an OH type anion exchange resin (Amberlite IR-400, produced by Rohm & Haas Co.) to reduce calcium and magnesium ion concentrations each to 3 mg/l or less. To the thus treated water were added 20 mg/l of sodium dichloroisocyanurate and 0.15 g/l of sodium sulfate. The resulting washing solution had a pH of 6.5 to 7.5.

| Stabilizer: | |
|---|---|
| The tank solution and replenisher had the same composition. | |
| Sodium p-toluenesulfinate | 0.03 g |

-continued

| Stabilizer: | |
|---|---|
| Polyoxyethylene p-monononyl phenyl ether (average degree of polymerization: 10) | 0.2 g |
| Disodium ethylenediaminetetraacetate | 0.05 g |
| 1,2,4-Triazole | 1.3 g |
| 1,4-Bis(1,2,4-triazol-1-ylmethyl)-piperazine | 0.75 g |
| Water to make | 1.0 l |
| pH | 8.5 |

The density of the processed sample was measured with a green filter. The sensitivity was expressed relatively in terms of exposure giving a density of (fog density+0.2). Further, the same samples were preserved at 50° C. and 60% RH for 14 days before or after the exposure, and the sensitivity and fog were measured. The results obtained are shown in Table 1 below.

TABLE 1

| Sample | | Compound | Fresh | | 50° C., 60% RH × 14 dys Before Exposure | | 50° C., 60% RH × 14 Dys After Exposure | |
|---|---|---|---|---|---|---|---|---|
| No. | Emulsion | of (I) | Fog | Sensitivity | Fog | Sensitivity | Fog | Sensitivity |
| 301 | Y | none | 0.22 | 100 | 0.36 | 93 | 0.36 | 78 |
| 302 | Y | (19) | 0.20 | 105 | 0.30 | 100 | 0.30 | 89 |
| 303 | Y | (21) | 0.19 | 105 | 0.24 | 100 | 0.24 | 96 |
| 304 | Y | (23) | 0.18 | 105 | 0.24 | 100 | 0.24 | 96 |
| 305 | Z | none | 0.47 | 112 | 1.21 | 64 | 1.21 | 77 |
| 306 | Z | (19) | 0.28 | 141 | 0.46 | 125 | 0.46 | 128 |
| 307 | Z | (21) | 0.23 | 166 | 0.27 | 159 | 0.27 | 151 |
| 308 | Z | (23) | 0.18 | 195 | 0.24 | 186 | 0.24 | 173 |

On comparing sample 301 with samples 302 to 304, it is seen that the compound of formula (I) according to the present invention, when added to an emulsion which has not been reduction sensitized, suppresses fog and increases the sensitivity of a fresh light-sensitive material. These effects are appreciably manifested when the compound is applied to a reduction sensitized emulsion. That is, comparison between sample 305 and samples 306 to 308 proves that addition of the compound of the present invention to a reduction sensitized emulsion brings about remarkable suppression of fog and a great increase of sensitivity.

What is more surprising is the effect of the compound of the present invention on improvement of preservation stability either before and after exposure. In the case of non-reduction sensitized emulsion, it is seen, from the comparison between sample 301 and samples 302 to 304, that the changes in fog and sensitivity due to preservation is reduced by addition of the compound of the present invention. This effect is extremely conspicuous in reduction-sensitized emulsion as can be seen on comparing sample 305 and samples 306 to 308. That is, preservation stability of a light-sensitive material either before or after exposure is markedly improved by using a reduction sensitized emulsion containing the compound of the present invention.

Further, samples 301 to 308 with its emulsion side scratched with a needle of 50 μm in diameter under a load of 4 g were exposed and processed in the same manner as described above, and an increase in fog density due to the scratches was obtained. The results are shown in Table 2.

TABLE 2

| Sample No. | Emulsion | Compound of (I) | Increase in Fog |
|---|---|---|---|
| 301 | Y | none | 0.64 |
| 302 | Y | (19) | 0.42 |
| 303 | Y | (21) | 0.38 |
| 304 | Y | (23) | 0.38 |
| 305 | Z | none | 0.92 |
| 306 | Z | (19) | 0.48 |
| 307 | Z | (21) | 0.40 |
| 308 | Z | (23) | 0.40 |

On comparing sample 301 with samples 302 to 304, it is seen that addition of the compound of the present invention reduces pressure-induced fog, i.e., brings about improvement in pressure characteristics. The comparison between sample 305 and samples 306 to 308 verifies that the effect is extremely remarkable in reduction sensitized emulsions.

EXAMPLE 2

Example 2 is to further prove the effects of various hydrazine compounds of formula (I) according to the present invention.

Emulsions were prepared in the same manner as for emulsion Z of Example 1, except for adding $2\times10^{-5}$ mol of compound (5), (10), (18), (20), (31) or (34) per mole of silver halide at the time of chemical sensitization to perform optimum chemical sensitization.

The resulting emulsion was applied to a support to prepare samples 401 to 408, the samples were exposed and processed, and the sensitivity and fog were determined in the same manner as in Example 1. The results obtained are shown in Table 3.

TABLE 3

| Sample No. | Emulsion | Compound of (I) | Fog | Sensitivity |
|---|---|---|---|---|
| 401 | Z | none | 0.47 | 112 |
| 402 | Z | (5) | 0.26 | 141 |
| 403 | Z | (10) | 0.24 | 153 |
| 404 | Z | (13) | 0.24 | 141 |
| 405 | Z | (18) | 0.22 | 158 |
| 406 | Z | (20) | 0.16 | 202 |
| 407 | Z | (31) | 0.19 | 188 |
| 408 | Z | (34) | 0.21 | 178 |

As is apparent from Table 3, the compounds of the present invention produce an appreciable effect on improvement of sensitivity/fog ratio, while the extent of the effect varies among the compounds. In particular, compound (20) is effective to reduce the fog nearly to ⅓ and to approximately double the sensitivity.

EXAMPLE 3

Application of the emulsions according to the present invention to light-sensitive materials furnished photographic materials excellent in sensitivity/fog ratio, pressure characteristics, and preservation characteristics.

A cellulose triacetate film support having a subbing layer was coated with the following layers to prepare a multilayer color light-sensitive material, designated sample 501.

Main materials used in sample preparation are classified into cyan couplers (ExC), magenta couplers (ExM), yellow couplers (ExY), sensitizing dyes (ExS), ultraviolet absorbers (UV), high-boiling organic solvents (HBS), and gelatin hardening agents (H).

The figures of each component are a coating weight (g) per $m^2$. The coating weights for silver halide are given on silver conversion, and those for sensitizing dyes are given in molar quantity per mole of silver halide of the same layer.

| | |
|---|---|
| 1st Layer (antihalation layer): | |
| Black colloidal silver | Ag-0.18 |
| Gelatin | 1.40 |
| ExM-1 | 0.11 |
| ExF-1 | $3.4 \times 10^{-3}$ |
| HBS-1 | 0.16 |
| 2nd Layer (intermediate layer): | |
| ExC-2 | 0.030 |
| UV-1 | 0.020 |
| UV-2 | 0.020 |
| UV-3 | 0.060 |
| HBS-1 | 0.05 |
| HBS-2 | 0.020 |
| Polyethyl acrylate latex | 0.080 |
| Gelatin | 0.90 |
| 3rd Layer (low-speed red-sensitive emulsion layer): | |
| Emulsion A | Ag-0.23 |
| Emulsion B | Ag-0.23 |
| ExS-1 | $5.0 \times 10^{-4}$ |
| ExS-2 | $1.8 \times 10^{-5}$ |
| ExS-3 | $5.0 \times 10^{-4}$ |
| ExC-1 | 0.050 |
| ExC-3 | 0.030 |
| ExC-4 | 0.14 |
| ExC-5 | $3.0 \times 10^{-3}$ |
| ExC-7 | $1.0 \times 10^{-3}$ |
| ExC-8 | 0.010 |
| Cpd-2 | 0.005 |
| HBS-1 | 0.10 |
| Gelatin | 0.90 |
| 4th Layer (middle-speed red-sensitive emulsion layer): | |
| Emulsion C | Ag-0.70 |
| ExS-1 | $3.4 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.050 |
| ExC-5 | 0.010 |
| ExC-8 | 0.010 |
| Cpd-2 | 0.023 |
| HBS-1 | 0.11 |
| Gelatin | 0.60 |
| 5th Layer (high-speed red-sensitive emulsion layer): | |
| Emulsion D | Ag-1.62 |
| ExS-1 | $2.4 \times 10^{-4}$ |
| ExS-2 | $1.0 \times 10^{-5}$ |
| ExS-3 | $3.0 \times 10^{-4}$ |
| ExC-1 | 0.10 |
| ExC-3 | 0.050 |
| ExC-5 | $2.0 \times 10^{-3}$ |
| ExC-6 | 0.010 |

-continued

| | |
|---|---|
| ExC-8 | 0.010 |
| Cpd-2 | 0.025 |
| HBS-1 | 0.20 |
| HBS-2 | 0.10 |
| Gelatin | 1.30 |
| 6th Layer (intermediate layer): | |
| Cpd-1 | 0.090 |
| HBS-1 | 0.05 |
| Polyethyl acrylate latex | 0.15 |
| Gelatin | 1.10 |
| 7th Layer (low-speed green-sensitive emulsion layer): | |
| Emulsion E | Ag-0.24 |
| Emulsion F | Ag-0.24 |
| ExS-4 | $4.0 \times 10^{-5}$ |
| ExS-5 | $1.8 \times 10^{-4}$ |
| ExS-6 | $6.5 \times 10^{-4}$ |
| ExM-1 | $5.0 \times 10^{-3}$ |
| ExM-2 | 0.28 |
| ExM-3 | 0.086 |
| ExM-4 | 0.030 |
| ExY-1 | 0.015 |
| HBS-1 | 0.30 |
| HBS-3 | 0.010 |
| Gelatin | 0.85 |
| 8th Layer (middle-speed green-sensitive emulsion layer): | |
| Emulsion G | Ag-0.94 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.14 |
| ExM-3 | 0.045 |
| ExM-5 | 0.020 |
| ExY-1 | $7.0 \times 10^{-3}$ |
| ExY-4 | $2.0 \times 10^{-3}$ |
| ExY-5 | 0.020 |
| HBS-1 | 0.16 |
| HBS-3 | $8.0 \times 10^{-3}$ |
| Gelatin | 0.80 |
| 9th Layer (high-speed green-sensitive emulsion layer): | |
| Emulsion H | Ag-1.29 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.050 |
| ExM-5 | 0.020 |
| ExY-4 | $5.0 \times 10^{-3}$ |
| Cpd-3 | 0.050 |
| HBS-1 | 0.20 |
| HBS-2 | 0.08 |
| Polyethyl acrylate latex | 0.26 |
| Gelatin | 1.45 |
| 10th Layer (yellow filter layer): | |
| Yellow colloidal silver | Ag-$7.5 \times 10^{-3}$ |
| Cpd-1 | 0.13 |
| Cpd-4 | $7.5 \times 10^{-3}$ |
| HBS-1 | 0.60 |
| Gelatin | 0.60 |
| 11th Layer (low-speed blue-sensitive emulsion layer): | |
| Emulsion I | Ag-0.25 |
| Emulsion J | Ag-0.25 |
| Emulsion K | Ag-0.10 |
| ExS-7 | $8.0 \times 10^{-4}$ |
| ExC-7 | 0.010 |
| ExY-1 | $5.0 \times 19^{-3}$ |
| ExY-2 | 0.40 |
| ExY-3 | 0.45 |
| ExY-4 | $6.0 \times 10^{-3}$ |
| ExY-6 | 0.10 |
| HBS-1 | 0.30 |
| Gelatin | 1.65 |

-continued

| | |
|---|---|
| 12th Layer (high-speed blue-sensitive emulsion layer): | |
| Emulsion L | Ag-1.30 |
| ExS-7 | $3.0 \times 10^{-4}$ |
| ExY-2 | 0.15 |
| ExY-3 | 0.06 |
| ExY-4 | $5.0 \times 10^{-3}$ |
| Cpd-2 | 0.10 |
| HBS-1 | 0.070 |
| Gelatin | 1.20 |
| 13th Layer (first protective layer): | |
| UV-2 | 0.10 |
| UV-3 | 0.12 |
| UV-4 | 0.30 |
| HBS-1 | 0.10 |
| Gelatin | 2.50 |
| 14th Layer (second protective layer): | |
| Emulsion M | Ag-0.10 |
| H-1 | 0.37 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

In addition, each layer appropriately contained W-1 to W-3, B-4 to B-6, F-1 to F-17, an iron salt, a lead salt, a gold salt, a platinum salt, an iridium slat, a palladium salt, or a rhodium salt for the purpose of improving preservability, processability, pressure resistance, antifungal and antibacterial properties, antistatic properties, and coating properties.

Cpd-4 was used in a solid dispersion in accordance with the process described in Int. Patent 88/4794.

Emulsions used in the sample preparation are shown in Table 4 below.

In Table 4: (1) Emulsions I to L had been reduction sensitized with thiourea dioxide and thiosulfonic acid at the time of grain preparation in accordance with Example of JP-A-2-191938. (2) Emulsions A to L had been subjected to gold sensitization, sulfur sensitization and selenium sensitization in the presence of the spectral sensitizing dyes described above in the respective layer composition. (3) The tabular emulsion grains were prepared by using low-molecular weight gelatin in accordance with Example of JP-A-1-158426. (4) The tabular grains were observed to have such dislocation lines as described in JP-A-3-237450 under a high voltage electron microscope.

In preparing the coating compositions of 3rd to 5th, 7th to 9th, and 11th to 12th layers, the couplers and other additives were dispersed in an aqueous gelatin solution by any of methods A to D described below. The dispersing method adopted to each layer and the average dispersed particle size of the dispersion are shown in Table 5 below.

Method A: A uniform aqueous solution of couplers, high-boiling organic solvents, surface active agents, NaOH, n-propanol and other additives is neutralized to precipitate, followed by dispersing.

Method B: A uniform n-propanol solution of couplers, high-boiling organic solvents and other additives is added to an aqueous surface active agent solution to precipitate, followed by dispersing.

Method C: A solution of couplers, high-boiling organic solvents, surface active agents, low-boiling organic solvents, and other additives and an aqueous solution of gelatin and surface active agents are mixed, stirred, and emulsified, followed by evaporation to remove the low-boiling organic solvent.

Method D: The same as method C, except that the solvent is removed by washing with water or ultrafiltration.

TABLE 4

| Emulsion | Grain Shape (Halogen Structure) | Average AgI Content (%) | C.V* of AgI Content Among Grains (%) | Average Grain Size** (μm) | C.V. of Grain Size (%) | Aspect Ratio |
|---|---|---|---|---|---|---|
| A | circular table (homogeneous) | 0 | — | 0.45 | 15 | 5.5 |
| B | cube (double layered, high AgI in the shell) | 1.0 | — | 0.20 | 8 | 1 |
| C | tetradecahedron (three layered, high AgI in the intermediate layer) | 4.5 | 25 | 0.85 | 18 | 1 |
| D | hexagonal table (high AgI on the surface side) | 2.0 | 16 | 1.10 | 17 | 7.5 |
| E | circular table (high AgI on the surface side) | 1.0 | — | 0.45 | 15 | 3.0 |
| F | octahedron (double layered, high AgI in the core) | 6.0 | 22 | 0.25 | 8 | 1 |
| G | tetradecahedron (three layered, high AgI in the intermediate layer) | 4.5 | 19 | 0.85 | 19 | 1 |
| H | hexagonal table (high AgI on the surface side) | 3.5 | 16 | 1.10 | 16 | 6.8 |
| I | circular table (high AgI in the central portion) | 2.0 | 15 | 0.45 | 15 | 6.0 |
| J | cube (homogeneous) | 1.0 | 10 | 0.30 | 8 | 1 |
| K | tetradecahedron (double layered, high AgI in the core) | 18.0 | 8 | 0.80 | 18 | 1 |
| L | hexagonal table (three layered, high AgI in the intermediate layer) | 12.0 | 12 | 1.35 | 22 | 12.0 |
| M | light-insensitive fine grains (homogeneous) | 1.0 | — | 0.04 | 15 | 1 |

Note:
*Coefficient of variation.
**Sphere-equivalent diameter.

TABLE 5
| Layer | Method of Dispersion | Average Dispersed Particle Size (nm) |
|---|---|---|
| 3rd | C | 133 |
| 4th | C | 130 |
| 5th | D | 40 |
| 7th | C | 135 |
| 8th | C | 60 |
| 9th | A | 40 |
| 11th | C | 125 |
| 12th | B | 80 |
The couplers and other additives used in the sample preparation are shown below.
ExC-1
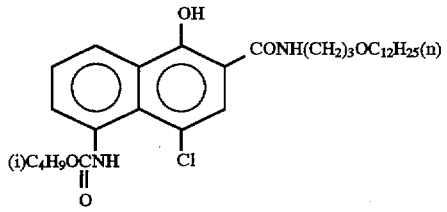
ExC-2
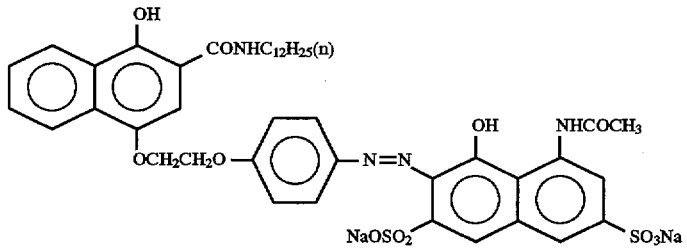
ExC-3
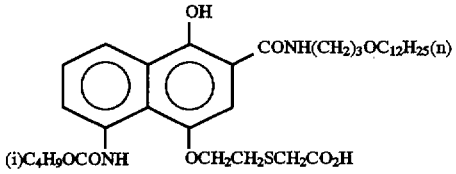
ExC-4
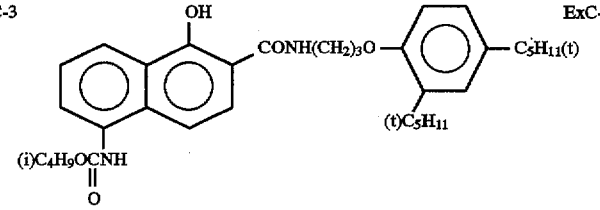
ExC-5
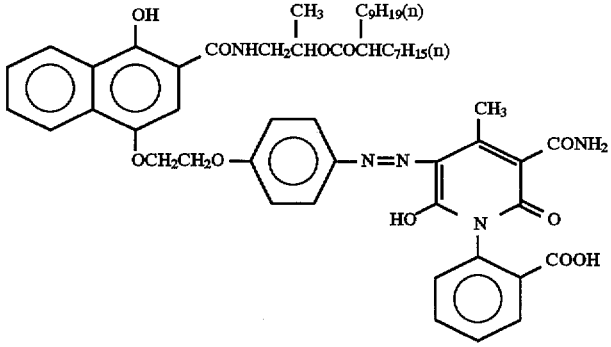

-continued
ExC-6
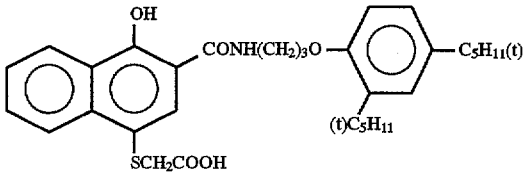
ExC-7
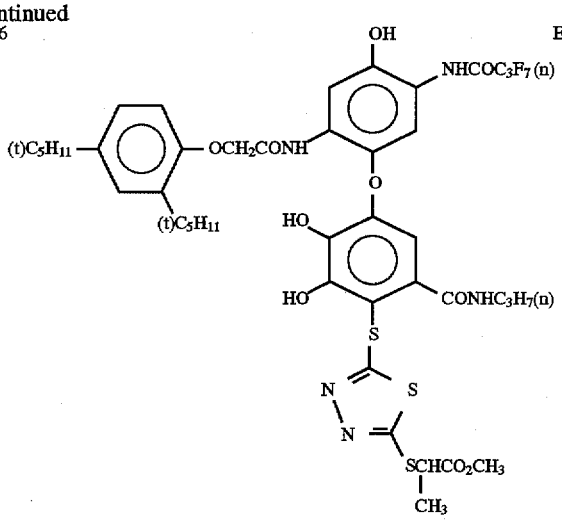
ExC-8
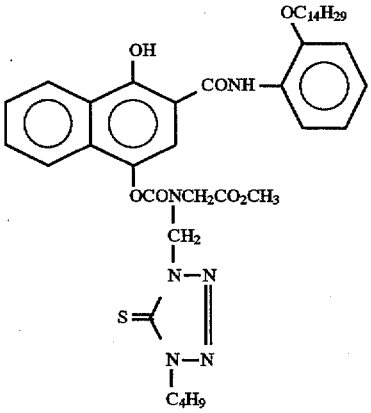
ExM-1
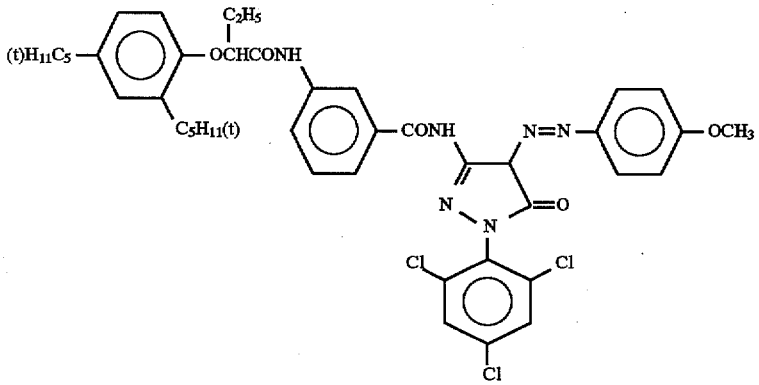
ExM-2
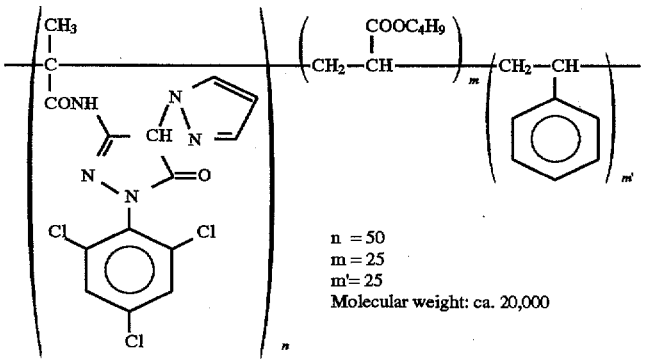
n = 50
m = 25
m' = 25
Molecular weight: ca. 20,000

-continued
ExM-3
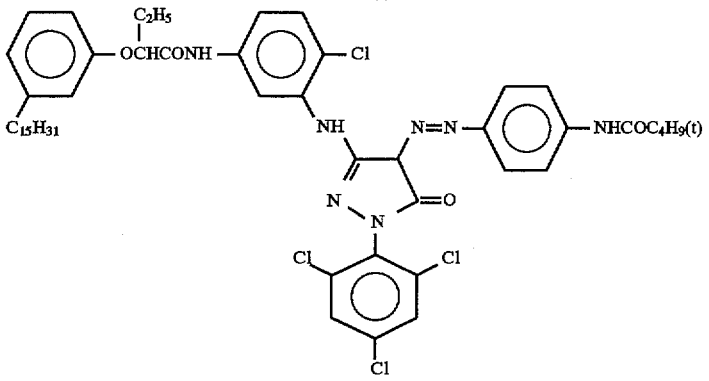
ExM-4
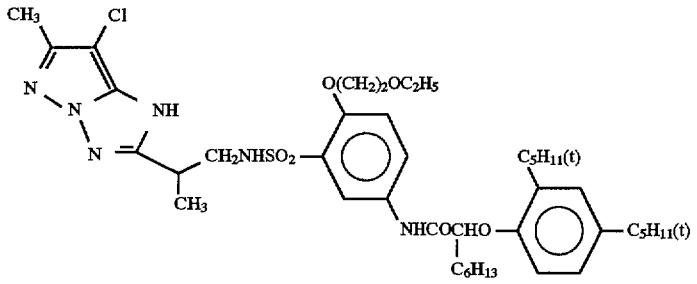
ExM-5
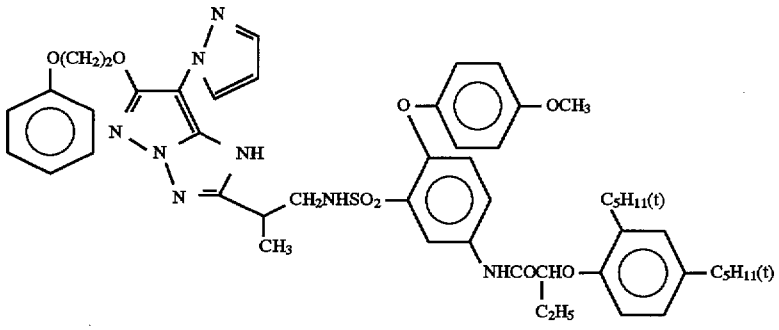
ExY-1
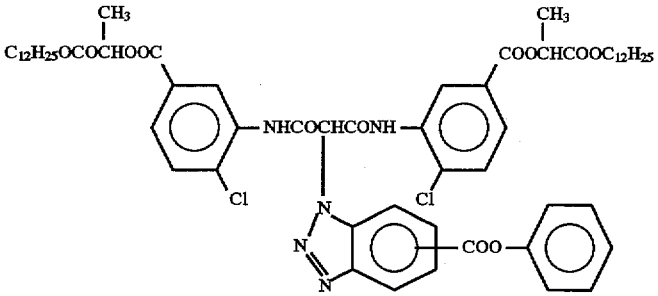
ExY-2
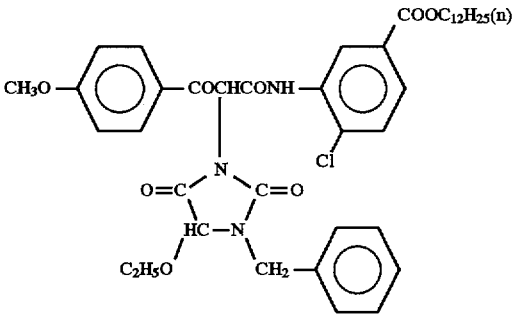
ExY-3
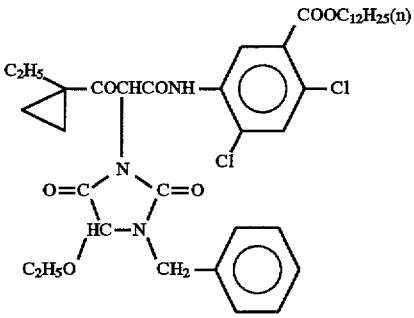

-continued
ExY-4
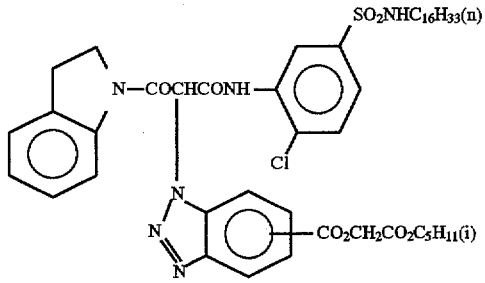
ExY-5
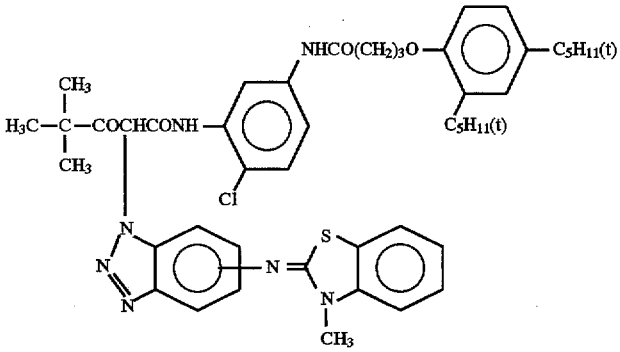
ExY-6
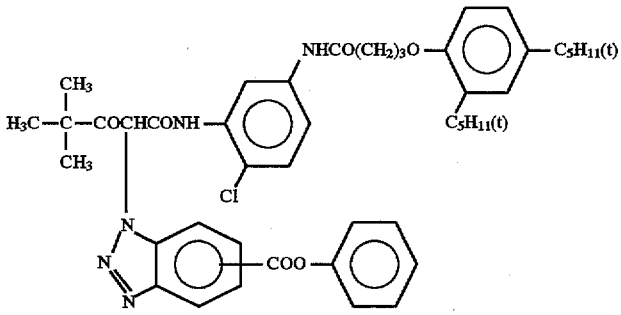
ExF-1
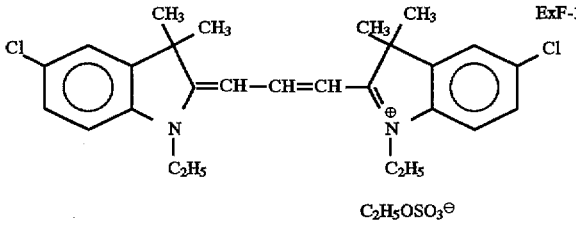
Cpd-1
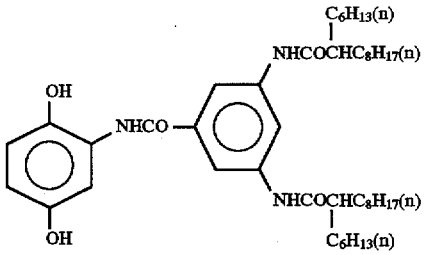
Cpd-2
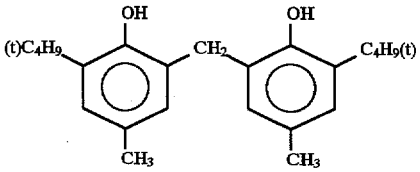
Cpd-3
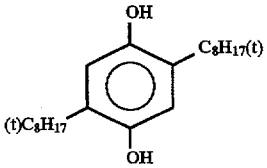
Cpd-4
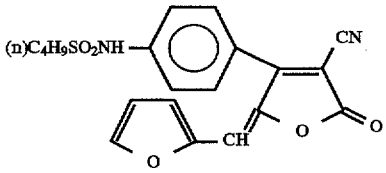
UV-1
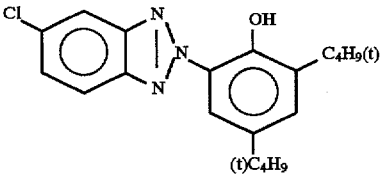

-continued
UV-2
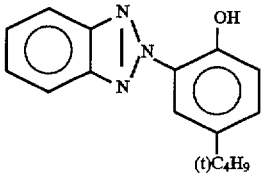
UV-3
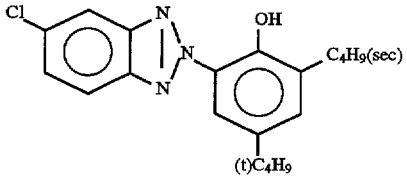
UV-4
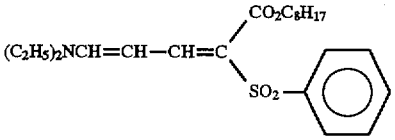
Tricresyl phosphate HBS-1
Di-n-butyl phthalate HBS-2
HBS-3
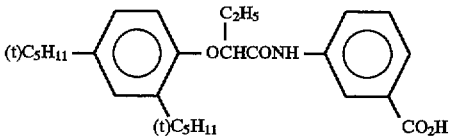
ExS-1
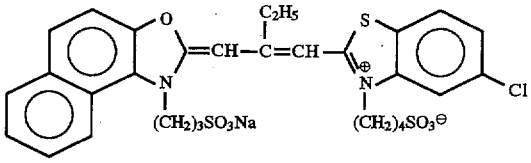
ExS-2
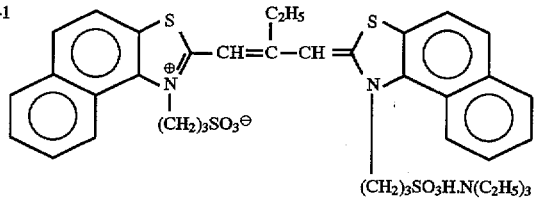
ExS-3
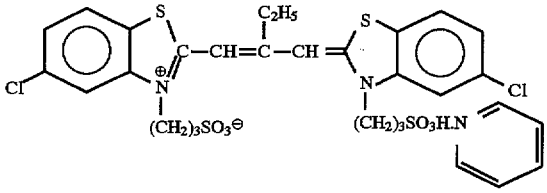
ExS-4
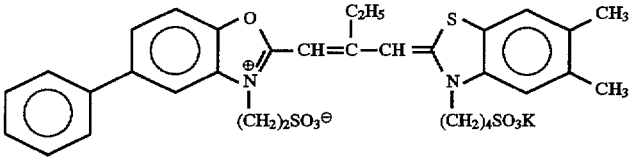
ExS-5
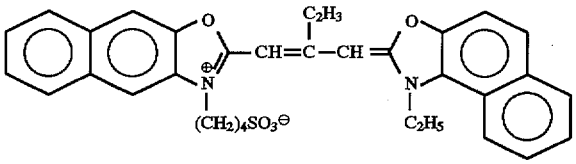
ExS-6
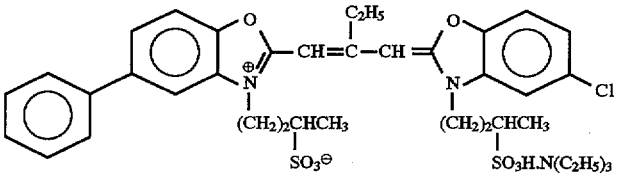
ExS-7
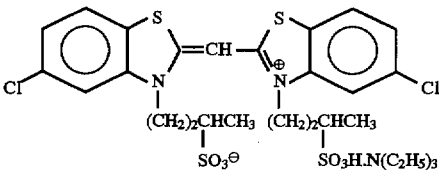
S-1
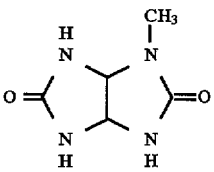

-continued
H-1
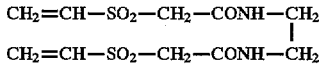
B-1
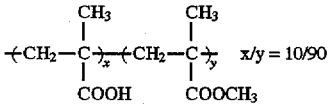
x/y = 10/90
B-2
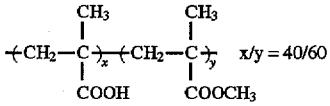
x/y = 40/60
B-3
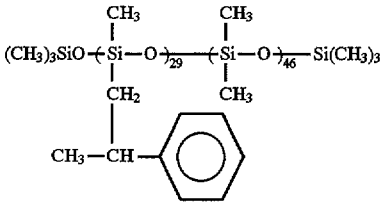
B-4
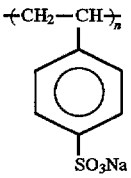
B-5
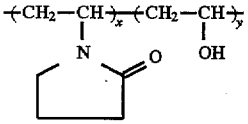
x/y = 70/30
B-6
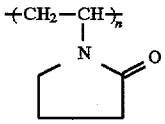
Molecular weight: ca.10,000
W-1
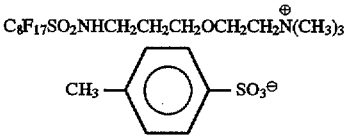
W-2
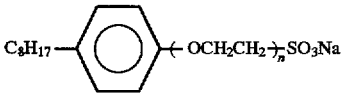
n = 2 to 4
W-3
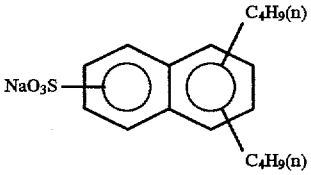
F-1
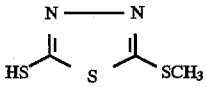
F-2
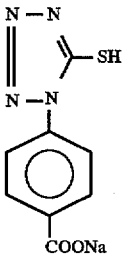
F-3
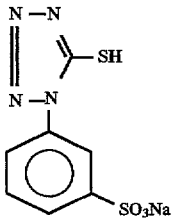
F-4
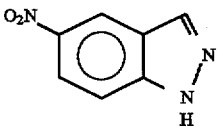
F-5
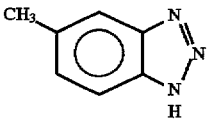
F-6
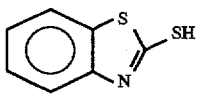

-continued

F-7

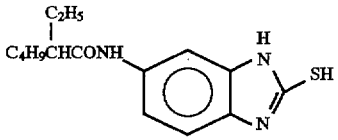

F-8

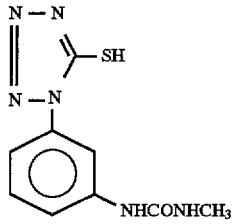

F-9

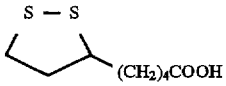

F-10

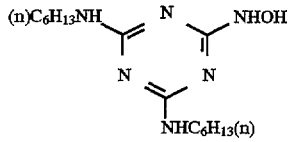

F-11

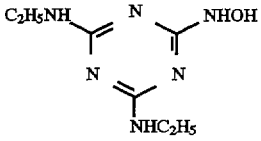

F-12

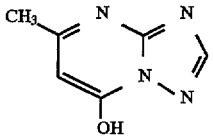

F-13

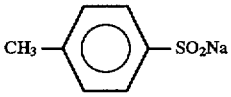

F-14

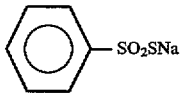

F-15

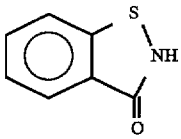

F-16

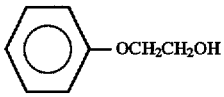

F-17

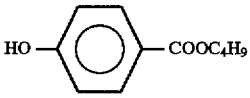

EXAMPLE 4

The sample prepared in Example 3 was processed as follows and evaluated in the same manner as in Example 3. As a result, the same effects as observed in Example 3 were verified.

Processing Schedule:

| Step | Time | Temp. (°C.) | Rate of Replenishment (ml/35 mm × 1 m) | Tank Capacity (l) |
|---|---|---|---|---|
| Color development | 3'15" | 38 | 22 | 40 |
| Stopping | 1' | 38 | 10 | 20 |
| Washing (1) | 1' | 24 | 200 | 20 |
| Bleaching* | 3' | 38 | 10 | 40 |
| Washing (2) | 1' | 24 | 200 | 20 |
| Fixing | 3' | 38 | 15 | 40 |
| Washing (3) | 1' | 24 | counter-current flow system from (4) to (3) | 20 |
| Washing (4) | 1' | 24 | 200 | 20 |
| Stabilization | 1' | 38 | 15 | 20 |
| Drying | 4' | 55 | | |

Note: *The bleaching tank was equipped with an aeration means, and the bath was aerated at a rate of 1 l/min.

The processing solutions used had the following compositions.

| | Tank Solution (g) | Replenisher (g) |
|---|---|---|
| Color Developer: | | |
| Diethylenetriaminepentaacetic acid | 1.0 | 1.2 |
| 1-Hydroxyethylidene-1,1-diphosphonic acid | 2.0 | 2.2 |
| Sodium sulfite | 4.0 | 4.8 |
| Potassium carbonate | 30.0 | 39.0 |
| Potassium bromide | 1.4 | 0.3 |
| Potassium iodide | 1.5 mg | — |
| hydroxylamine sulfate | 2.4 | 3.1 |
| 4-[N-Ethyl-N-(β-hydroxyethyl)amino]-2-methylaniline sulfate | 4.5 | 6.0 |
| Water to make | 1.0 l | 1.0 l |
| pH (adjusted with potassium hydroxide and sulfuric acid) | 10.05 | 10.15 |
| Stopping Bath: | | |
| Acetic acid (90%) | 40 | 60 |
| Water to make | 1.0 l | 1.0 l |
| pH (adjusted with potassium hydroxide) | 4.0 | 3.0 |
| Bleaching Bath: | | |
| 2,6-Pyridinedicarboxylic acid | 4.6 | 6.9 |
| Ferric nitrate (nonahydrate) | 5.1 | 7.7 |
| Acetic acid (90%) | 67.0 | 100.0 |
| Sodium persulfate | 30.0 | 45.0 |
| Sodium chloride | 8.7 | 13.0 |
| Aqueous ammonia (27%) | 38.0 ml | 50.0 ml |
| Water to make | 1.0 l | 1.0 l |

-continued

| | Tank Solution (g) | Replenisher (g) |
|---|---|---|
| pH | 4.0 | 3.7 |
| Blix Bath: | | |
| Disodium ethylenediaminetetraacetate | 0.5 | 0.7 |
| Ammonium sulfite | 20.0 | 22.0 |
| Ammonium thiosulfate aqueous solution (700 g/l) | 295.0 ml | 320.0 ml |
| Acetic acid (90%) | 3.3 | 4.0 |
| Water to make | 1.0 l | 1.0 l |
| pH (adjusted with aqueous ammonia and acetic acid) | 6.7 | 6.8 |
| Stabilizer: | | |
| The tank solution and replenisher had the same composition. | | |
| p-Nonylphenoxypolyglycidol (average degree of glycidol polymerization: 10) | 0.2 g | |
| Ethylenediaminetetraacetic acid | 0.05 g | |
| 1,2,4-Triazole | 1.3 g | |
| 1,4-Bis(1,2,4-triazol-1-ylmethyl)-piperazine | 0.75 g | |
| Hydroxyacetic acid | 0.02 g | |
| Hydroxyethyl cellulose (HEC SP-200, produced by Daicel Chemical Industries, Ltd.) | 0.1 g | |
| 1,2-Benzoisothiazolin-3-one | 0.05 g | |
| Water to make | 1.0 l | |
| pH | 8.5 | |

According to the present invention, remarkable reduction in fog, improvement in preservability and increase in sensitivity can be achieved by incorporating the compound of formula (I) to a silver halide photographic material containing a reduction sensitized silver halide emulsion.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive layer, said photographic material comprising a reduction-sensitized silver halide emulsion containing at least one compound represented by formula (I):

$$(Het)_{k1}-\{(Q)_{k2}-(Hy)\}_{k3} \quad (I)$$

wherein Het represents a group adsorptive to silver halide grains selected from the group consisting of:

(1) a 5-, 6- or 7-membered heterocyclic ring having 2 or more hetero atoms, (2) a 5-, 6- or 7-membered nitrogen-containing heterocyclic ring having a quaternary nitrogen atom, which is represented by formula (A):

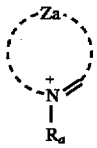

(A)

(3) a 5-, 6- or 7-membered nitrogen-containing heterocyclic ring having a thioxo group, which is represented by formula (B):

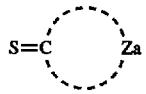

(B)

(4) a 5-, 6- or 7-membered nitrogen-containing heterocyclic ring represented by formula (C):

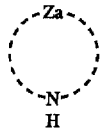

(C)

and (5) a 5-, 6- or 7-membered nitrogen-containing heterocyclic ring represented by formula (D) or (E),

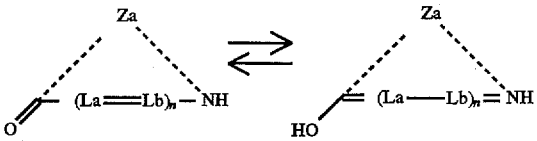

(D)

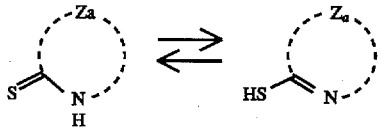

(E)

wherein Za represents an atomic group necessary to form a 5-, 6- or 7-membered nitrogen-containing heterocyclic ring; Ra represents an aliphatic group; La and Lb each represent a methine group; and n represents 0, 1 or 2, provided that Her is substituted with at least one $-(Q)_{k2}-(Hy)$ moiety; Q represents a divalent linking group comprising an atom selected from the group consisting of a carbon atom, a nitrogen atom, a sulfur atom and an oxygen atom or an atomic group containing at least one atom selected from the group consisting of a carbon atom, a nitrogen atom, a sulfur atom, and an oxygen atom; Hy represents a hydrazine structure represented by formula (II):

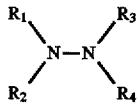

(II)

wherein $R_1$, $R_2$, $R_3$, and $R_4$ each represent an aliphatic group, an aryl group or a heterocyclic group; $R_1$ and $R_2$, $R_3$ and $R_4$, $R_1$ and $R_3$, or $R_2$ and $R_4$ may be connected to each other to form a ring, provided that at least one of $R_1$, $R_2$, $R_3$, and $R_4$ represents a divalent aliphatic, aryl or heterocyclic group to which the $-(Q)_{k2}-(Het)_{k1}$ moiety is bonded;

k1 and k3 each represent 1, 2, 3 or 4; and k2 represents 0 or 1.

2. A silver halide photographic material as claimed in claim 1, wherein said silver halide emulsion is a gold-chalcogen sensitized emulsion.

3. A silver halide photographic material as claimed in claim 1, wherein said silver halide emulsion is a spectrally sensitized emulsion.

4. A silver halide photographic material as claimed in claim 2, wherein said silver halide emulsion is a spectrally sensitized emulsion.

5. A silver halide photographic material as claimed in claim 1, wherein said compound represented by formula (I)

is selected from compounds represented by one of formulae (XI) to (XV):

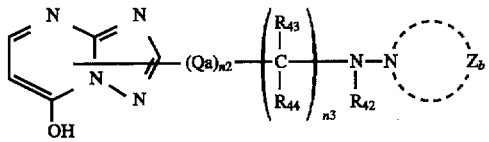

(XI)

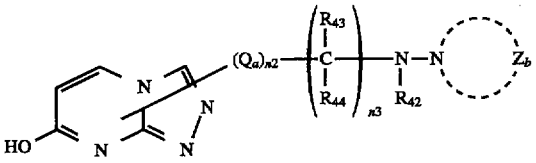

(XII)

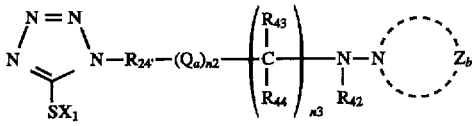

(XIII)

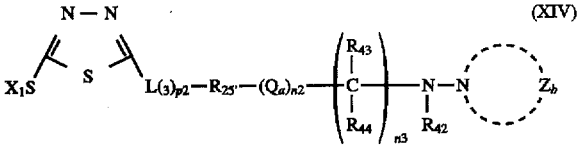

(XIV)

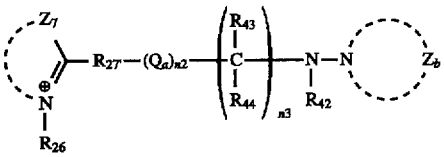

(XV)

wherein Qa has the same meaning a Q; Zb represents an alkylene group having 4 to 6 carbon atoms; $R_{42}$ represents an aliphatic group, an aryl group or a heterocyclic group; $R_{43}$ and $R_{44}$ each represent a hydrogen atom or a monovalent substituent; p2 represents an integer of 0 or more; $X_1$ represents a hydrogen atom, an alkali metal atom, an ammonium group or a precursor thereof; $R_{26}$ represents an aliphatic group; n2 represents 0 or 1; n3 represents an integer of 1 to 6; where n3 is 2 or more, the $C(R_{43})(R_{44})$ groups do not need to be the same; $R_{24}'$ and $R_{25}'$ each represent an alkylene group, an arylene group or a divalent heterocyclic group; and $R_{27}'$ represents an alkylene group.

6. A silver halide photographic material as claimed in claim 1, wherein said compound represented by formula (I) is selected from a compound represented by formula (XVI):

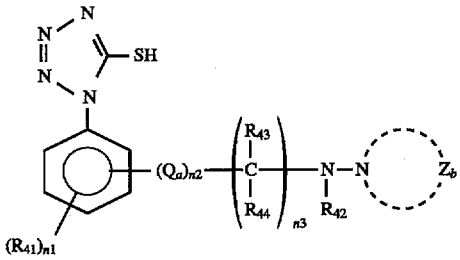

(XVI)

wherein Qa has the same meaning as Q; Zb represents a substituted or unsubstituted alkylene group having 4 to 6 carbon atoms, provided that the carbon atom directly bonded to the nitrogen atom of the hydrazine structure is not substituted with an oxo group; $R_{41}$ represents a monovalent substituent; $R_{42}$ represents an aliphatic group, an aryl group or a heterocyclic group; $R_{43}$ and $R_{44}$ each independently represent a hydrogen atom or a monovalent substituent; n1 represents 0 or an integer of 1 to 4; n2 represents 0 or 1; and n3 represents an integer of 1 to 6; where n1 or n3 is 2 or more, the $R_{41}$ or $C(R_{43})(R_{44})$ groups do not need to be the same.

* * * * *